US008434182B2

(12) United States Patent
Horvath et al.

(10) Patent No.: US 8,434,182 B2
(45) **Date of Patent: *May 7, 2013**

(54) POOL CLEANER WITH HIGH PRESSURE CLEANING JETS

(75) Inventors: Tibor Horvath, Estero, FL (US); Giora Erlich, North Caldwell, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 1420 days.

This patent is subject to a terminal disclaimer.

(21) Appl. No.: 12/079,667

(22) Filed: Mar. 26, 2008

(65) Prior Publication Data

US 2008/0236628 A1 Oct. 2, 2008

Related U.S. Application Data

(60) Continuation-in-part of application No. 11/606,809, filed on Nov. 29, 2006, now Pat. No. 7,827,643, which is a division of application No. 10/793,447, filed on Mar. 3, 2004, now Pat. No. 7,165,284, which is a division of application No. 10/109,689, filed on Mar. 29, 2002, now Pat. No. 6,742,613, which is a division of application No. 09/237,301, filed on Jan. 25, 1999, now Pat. No. 6,412,133.

(51) Int. Cl.
*E04H 4/16* (2006.01)

(52) U.S. Cl.
USPC ..... 15/1.7

(58) Field of Classification Search ..... 15/1.7
See application file for complete search history.

(56) References Cited

U.S. PATENT DOCUMENTS

| | | | |
|---|---|---|---|
| 2,104,365 | A | 1/1938 | Fuchs |
| 2,146,021 | A | 2/1939 | Lohr et al. |
| 2,683,956 | A | 7/1954 | Conte |

(Continued)

FOREIGN PATENT DOCUMENTS

| | | |
|---|---|---|
| DE | 7140569 U | 3/1972 |
| DE | 3110203 | 9/1982 |

(Continued)

OTHER PUBLICATIONS

International Preliminary Report on Patentability and Written Opinion, PCT/US2009/001968, Oct. 7, 2010.

*Primary Examiner* — Randall Chin
(74) *Attorney, Agent, or Firm* — Abelman, Frayne & Schwab

(57) ABSTRACT

A pool cleaning apparatus includes a housing and a pump for drawing water and debris through an intake port into a filter. A jet-valve housing having a jet valve flap is mounted over the pump to direct a propulsion jet stream from the pump to move the cleaner in a forward direction. A cleaning nozzle is mounted over each of the front and rear portions of the housing, and a pressurized water jet stream is directed at a first pool surface beneath the cleaner through the front end nozzle while moving in a forward direction. When the cleaner engages a second pool surface substantially perpendicular to the first surface, propulsion outlets of the jet valve housing are partially closed to redirect a portion of the propulsion jet stream to the front-end nozzle to lift the front end of the cleaner off the first surface. When the front end of the cleaner disengages from contact with the second surface, the propulsion outlets open to permit the propulsion jet stream to propel the cleaner along the second surface.

27 Claims, 22 Drawing Sheets

U.S. PATENT DOCUMENTS

| | | | |
|---|---|---|---|
| 2,923,954 | A | 2/1960 | Babcock |
| 2,943,418 | A | 7/1960 | Smith |
| 2,988,762 | A | 6/1961 | Babcock |
| 3,102,289 | A | 9/1963 | Norris |
| 3,229,315 | A | 1/1966 | Watson |
| 3,287,755 | A | 11/1966 | Pansini |
| 3,291,145 | A | 12/1966 | Arneson |
| 3,412,862 | A | 11/1968 | Chaplin |
| 3,439,368 | A | 4/1969 | Myers |
| 3,444,575 | A | 5/1969 | Martin |
| 3,551,930 | A | 1/1971 | Myers |
| 3,689,408 | A | 9/1972 | Edminston et al. |
| 3,822,754 | A | 7/1974 | Henkin et al. |
| 3,860,518 | A | 1/1975 | Henricksen |
| 3,871,129 | A | 3/1975 | Tong |
| 3,979,788 | A | 9/1976 | Strausak |
| 4,100,641 | A | 7/1978 | Pansini |
| 4,141,101 | A | 2/1979 | Gibellina |
| 4,169,484 | A | 10/1979 | Bonigut et al. |
| 4,193,228 | A | 3/1980 | Bowler |
| 4,281,995 | A | 8/1981 | Pansini |
| 4,348,192 | A | 9/1982 | Pansini |
| 4,429,429 | A | 2/1984 | Altschul |
| 4,463,520 | A | 8/1984 | Crosman |
| 4,558,479 | A | 12/1985 | Greskovics et al. |
| 4,589,986 | A | 5/1986 | Greskovics et al. |
| 4,801,087 | A | 1/1989 | Woodard |
| 4,837,886 | A | 6/1989 | Rawlins |
| 4,852,211 | A | 8/1989 | Strausak |
| 4,920,599 | A | 5/1990 | Rief |
| 5,099,535 | A | 3/1992 | Chauvier et al. |
| 5,133,503 | A | 7/1992 | Giordano et al. |
| 5,197,158 | A | 3/1993 | Moini |
| 5,317,777 | A | 6/1994 | Stoltz |
| 5,336,403 | A | 8/1994 | Marbach |
| 5,351,355 | A | 10/1994 | Chiniara |
| 5,655,246 | A | 8/1997 | Chang |
| 5,740,576 | A | 4/1998 | Sebor et al. |
| 5,893,188 | A | 4/1999 | Campbell et al. |
| 5,896,610 | A | 4/1999 | Sebor et al. |
| 5,974,347 | A | 10/1999 | Nelson |
| 5,985,156 | A | 11/1999 | Henkin et al. |
| 6,017,400 | A | 1/2000 | Clark et al. |
| 6,039,886 | A | 3/2000 | Henkin et al. |
| 6,280,611 | B1 | 8/2001 | Henkin et al. |
| 6,294,084 | B1 | 9/2001 | Henkin et al. |
| 6,365,039 | B1 | 4/2002 | Henkin et al. |
| 6,401,578 | B1 | 6/2002 | Domenge |
| 6,412,133 | B1 | 7/2002 | Erlich et al. |
| RE38,479 | E | 3/2004 | Henkin et al. |
| 6,751,822 | B2 * | 6/2004 | Phillipson et al. ..... 15/1.7 |
| 7,316,751 | B2 | 1/2008 | Horvath et al. |
| 2007/0101521 | A1 | 5/2007 | Erlich et al. |

FOREIGN PATENT DOCUMENTS

| | | |
|---|---|---|
| JP | 54-15365 | 2/1979 |
| JP | 54-45971 | 4/1979 |
| JP | 54-45972 | 4/1979 |
| JP | 54-50157 | 4/1979 |
| JP | 54-056251 | 5/1979 |
| JP | 54-003376 | 11/1979 |

* cited by examiner

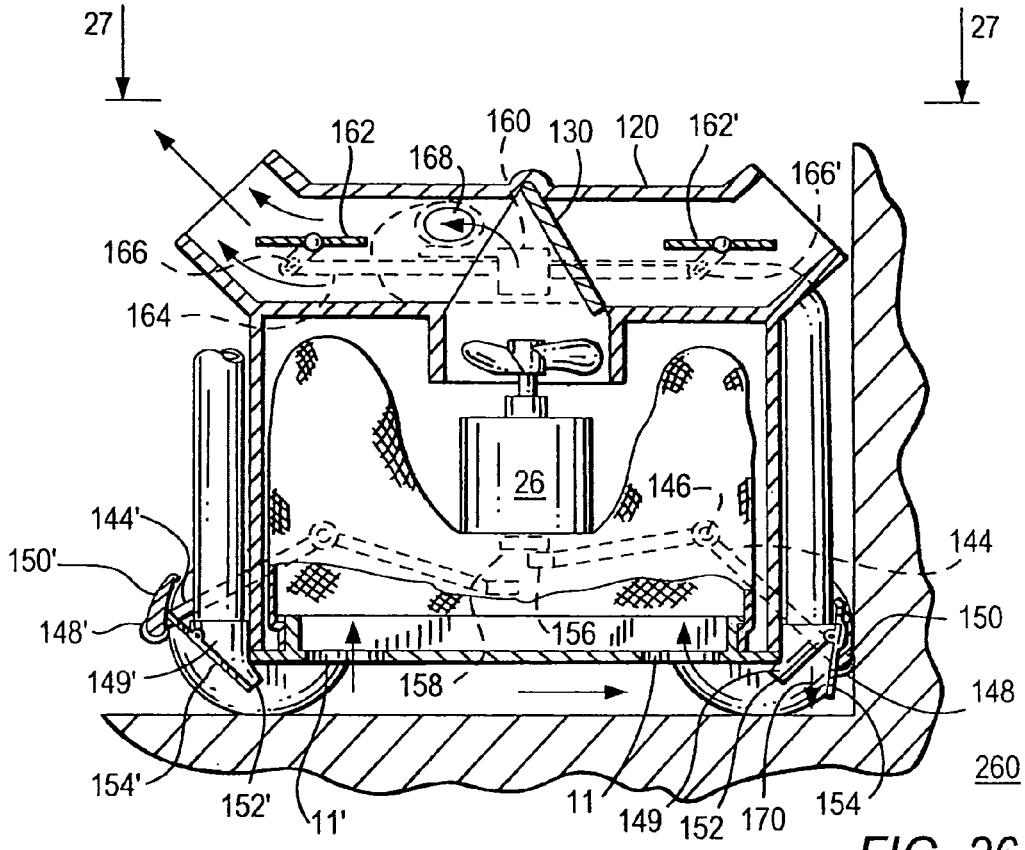
FIG. 26
FIG. 27
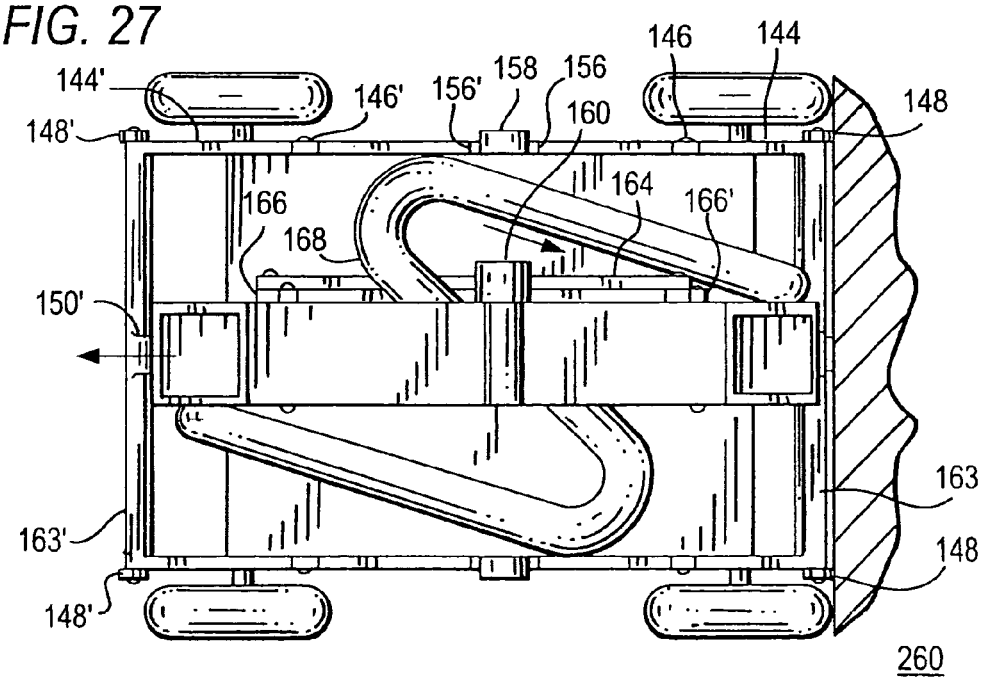

FIG. 31
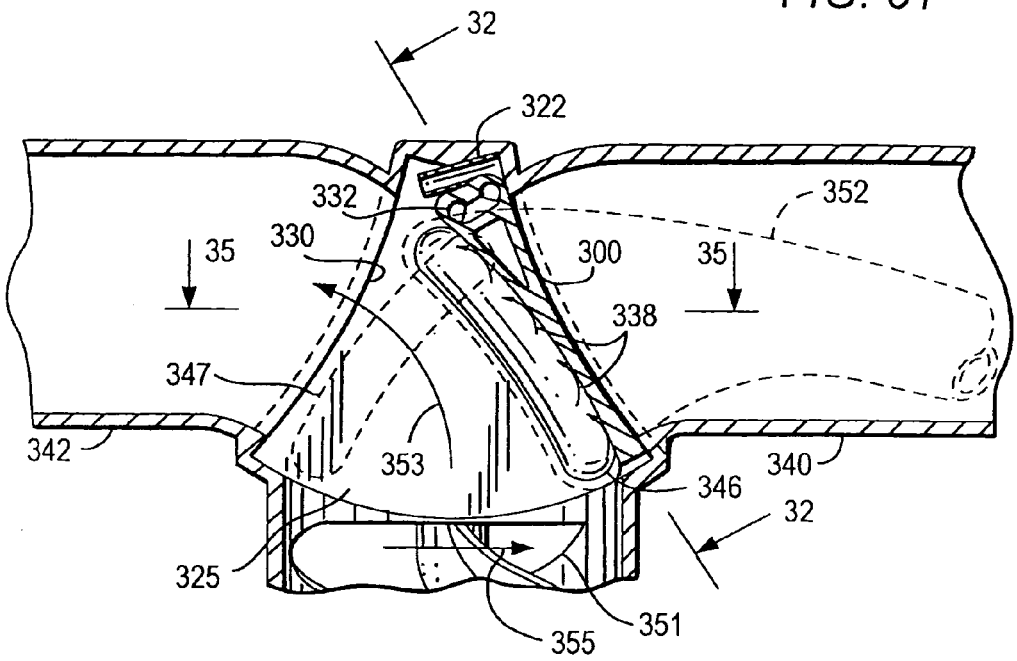
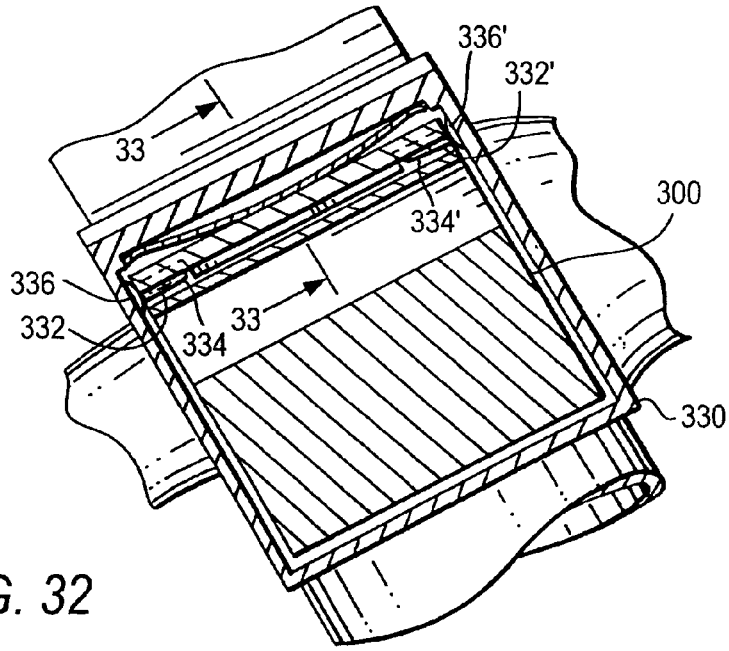
FIG. 32

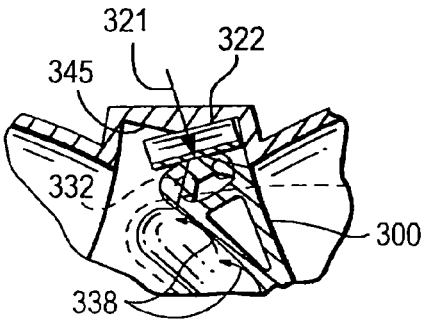
FIG. 33
FIG. 34
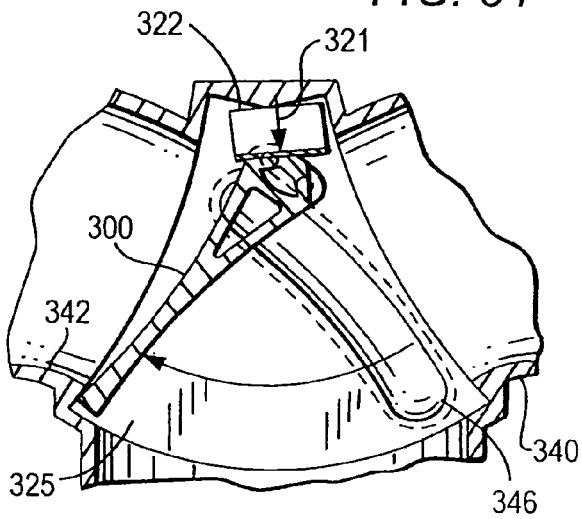
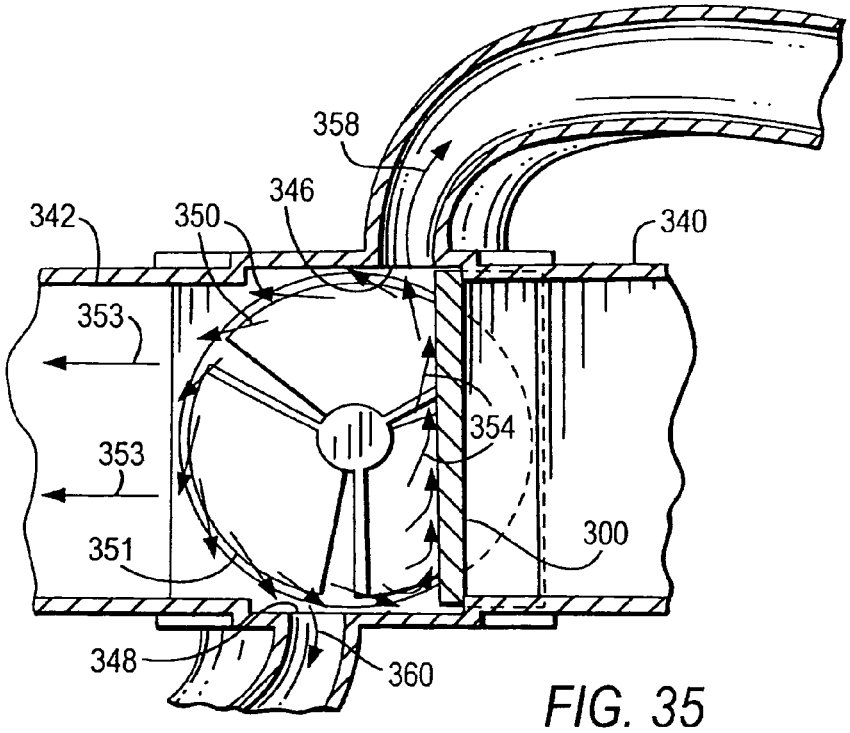
FIG. 35

POOL CLEANER WITH HIGH PRESSURE CLEANING JETS

CROSS REFERENCES TO RELATED APPLICATIONS

This application is related to application Ser. No. 12/079,666 co-filed Mar. 26, 2008, and is related to application Ser. No. 11/233,595, filed Sep. 22, 2005, now U.S. Pat. No. 7,316,751, which is a division of application Ser. No. 10/272,754, filed Oct. 17, 2002, now U.S. Pat. No. 6,971,136; and is a continuation-in-part of application Ser. No. 11/606,809, filed Nov. 29, 2006, now U.S. Pat. No. 7,827,643, which is a divisional of application Ser. No. 10/793,447, filed Mar. 3, 2004, now U.S. Pat. No. 7,165,284, which is a division of application Ser. No. 10/109,689, filed Mar. 29, 2002, now U.S. Pat. No. 6,742,613, which is a division of application Ser. No. 09/237,301, filed Jan. 25, 1999, now U.S. Pat. No. 6,412,133; the disclosures all of which are incorporated herein by reference in their entireties.

FIELD OF THE INVENTION

This invention relates to hand-powered and self-propelled pool and tank cleaners that draw water containing dirt and debris from the surface beneath the moving pool cleaner for entrainment in a filter.

BACKGROUND OF THE INVENTION

One of the most common problems that occurs in the disrupting of the efficient operation and pre-determined movement patterns of an automated swimming pool cleaner are discontinuities in and obstacles protruding from the bottom surface of the pool. When a self-propelled cleaner encounters and attempts to pass over or around an obstacle, it can become immobilized, particularly if the obstacle engages the opening of the vacuum intake. One approach to solving this problem has been to design the cleaner so that its baseplate and associated water intake is raised as high as possible from the surface to be vacuumed. However, the higher the intake, the less effective the vacuuming becomes. Debris is also left behind when the cleaner is moving rapidly. To counter these problems, the pool cleaner is programmed to move about its route at a rather sluggish pace. The result is that it may take many hours to clean an average size swimming pool.

It has also been proposed to equip the pool cleaner with flexible intake adapters to enhance the surface vacuuming ability of the cleaner. The intake adapters are also subject to being immobilized on steps or other protruding obstacles.

A further general problem of effectively and efficiently cleaning the bottom surface exists where the dirt and debris is heavy and/or when the pool has not been regularly cleaned and the movement of water into the intake ports in the bottom or baseplate of the pool cleaner is not sufficient to create the required turbulence at the surface to disturb and lift the dirt and debris into suspension so that it can be drawn to the intake port.

SUMMARY OF THE INVENTION

This invention relates to an improvement in the cleaning methods and apparatus that overcome the above-described shortcomings of pool cleaners of the prior art, whether hand-powered or of the self-propelled and robotic type. The introduction of water jets under the cleaner body, directed inboard and generally toward its center from its sides, agitates and lifts the dirt and debris, which is then moved toward the one or more baseplate intake ports, to greatly enhance the cleaning ability of the apparatus. The suspended dirt and debris become semi-buoyant under the force and turbulence of the jetted water.

In a preferred embodiment, a plurality of the directional water jets moves the debris in the same direction as the cleaner is moving. Thus, the relative speed between the cleaner and the suspended dirt and debris is reduced, enabling the cleaner to move at a relatively faster rate and still clean with equivalent, or even greater efficiency than a pool cleaner that is not equipped with the directional cleaning water jet apparatus. In addition, the front and back orientations of the intake slot allow a longer time for any dirt and debris to be picked up.

In one embodiment, the pool cleaning apparatus comprises a housing, an associated filter for entraining dirt and debris, a baseplate extending along the bottom of the housing, at least one intake port formed in the baseplate for admitting water into the filter, and a pump means for drawing water from beneath the pool cleaner baseplate and through the filter.

A pair of directional cleaning water jet nozzles is provided over the front and rear ends of the housing, in which each nozzle discharges a pressurized water jet stream at a first pool surface beneath the pool cleaning apparatus and as the cleaning apparatus moves in a forward direction. In particular, one of the pair of nozzles is mounted at a front end of the housing and the other nozzle is mounted on a rear end of the housing, such that dirt and debris resting on the first surface that is contacted by the pressurized stream in the forward direction is lifted into suspension proximate the intake port.

A jet valve housing having a jet valve is mounted on the housing for directing a propulsion jet stream from the pump means through one of a pair of opposing propulsion outlets for propelling the cleaning apparatus in the forward direction. The jet valve housing further including a pair of opposing positioned ports for providing the pressurized water jet stream to the nozzle mounted at the front end of the housing. In one embodiment, the opposing positioned ports are diametrically opposed with respect to each other.

In another embodiment, the opposing positioned ports are positioned centrally along the jet valve housing. In this embodiment, the jet valve includes diametrically opposing flanges extending in opposite directions to close off the jet valve housing port associated with the rear end nozzle and contemporaneously open the opposing jet valve housing port associated with the front end nozzle when the cleaner is moving in the forward direction.

In yet another embodiment, the pressurized water jets through the nozzles can also be used to lift the front end of the pool cleaner to enable the cleaner to clean and transverse a pool surface that is substantially perpendicular to surface beneath the cleaner. In particular, the jet valve housing of the cleaner includes a pair of opposing propulsion outlets. Each propulsion outlet has a flap valve for partially opening and closing the pair of opposing propulsion outlets of the jet valve housing. A switch is provided for controlling the opening and closing the pair of opposing propulsion outlets. In one embodiment, the switch is a solenoid. An activation means is further provided for activating the switch. In one embodiment, the activation means is a reed switch that is closed from its normally open state to generate electrical power to the solenoid. In one embodiment, a rotatable lever having a magnet mounted on one end is used to activate the reed switch. A second end of leaver causes the lever to rotate by contact with a pool surface that is substantially perpendicular to the pool surface below the pool cleaner.

When the lever contacts the substantially perpendicular surface, the magnetic end of the lever rotates towards the reed switch to cause it to close and send a current signal to the solenoid. The solenoid closes the flap valves via a linking member and a portion of the propulsion jet stream normally discharged through the propulsion outlet of the jet valve housing is directed to the front end nozzle to lift the front end of the cleaner.

The cleaner is lifted by the force of the pressurized jet stream through the front end nozzle until power to the solenoid is terminated by disengaging contact between the lever and the substantially perpendicular wall. The flap valves then open and the pool cleaner continues to traverse the substantially perpendicular surface in the forward direction in a conventional manner. This process is repeated each time the cleaner comes into contact with a substantially perpendicular surface of the pool.

BRIEF DESCRIPTION OF THE DRAWINGS

Further advantages and features of the present invention will become apparent from the detailed description of a preferred embodiment of the invention with reference to the accompanying drawings, in which:

FIG. 26 is a side elevational view partly in cross-section of the embodiment of the invention utilized with a cleaner that is moved about the pool by water jet propulsion;

FIG. 27 is a top view of the cleaner of FIG. 26 taken along line 27-27;

FIG. 31 is a vertical cross-sectional view of the jet valve in its housing while under water pressure;

FIG. 32 is an angular cross-sectional view taken on line 32-32 of FIG. 31 showing the manner in which the valve is being supported by its housing;

FIG. 33 is a partial cross-sectional view taken on line 33-33 of FIG. 32 showing the support mechanism in more detail;

FIG. 34 is another vertical cross-sectional view of the valve chamber in which the valve has changed position when pump is turned off;

FIG. 35 is a cross-sectional horizontal view of the valve chamber taken on line 35-35 of FIG. 31 showing the difference between the volumes of water being expelled at the upper and lower taps.

Figure 1:
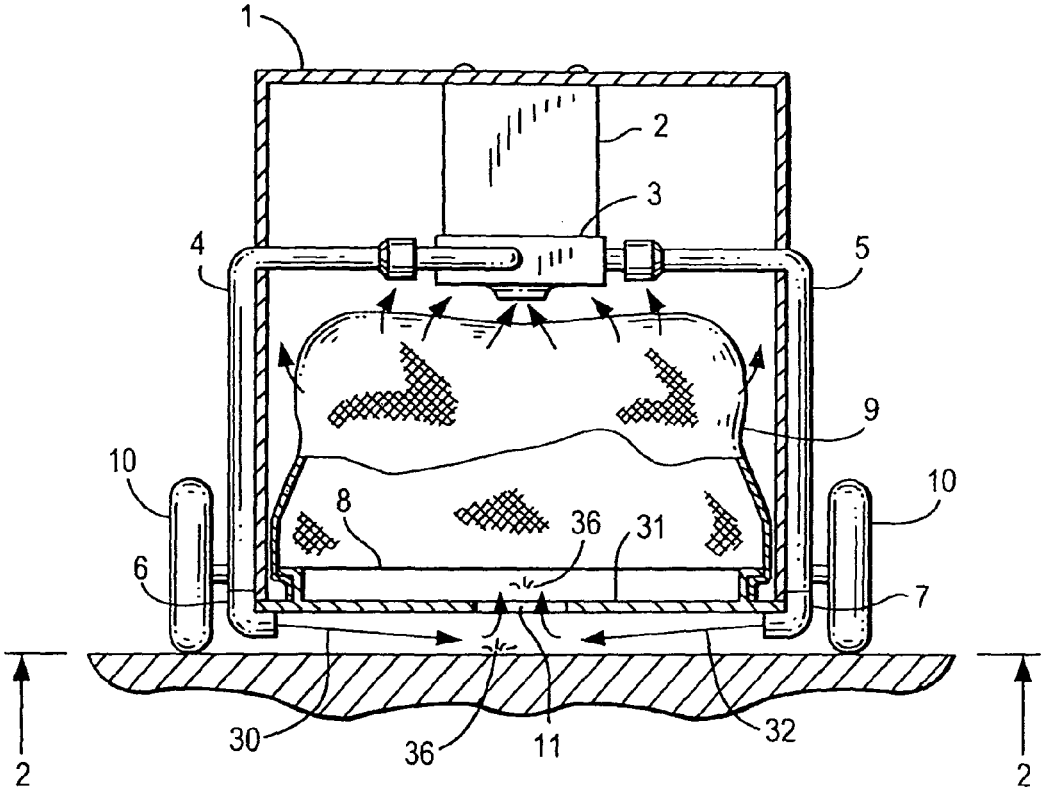
FIG. 1 is a cross-sectional view of a mechanically driven swimming pool cleaner of the present invention.

To facilitate understanding of the invention, identical reference numerals have been used, when appropriate, to designate the same or similar elements that are common to the figures. Further, unless stated otherwise, the drawings shown and discussed in the figures are not drawn to scale, but are shown for illustrative purposes only.

DETAILED DESCRIPTION OF THE PREFERRED EMBODIMENTS

Referring to FIG. 1, a first embodiment of a self-propelled robotic swimming pool cleaner implementing the present invention is shown, which includes a housing 1, an electric motor 2, a centrifugal pump 3, connecting tubes 4 and 5, jet nozzle elbows 6 and 7, filter bag holder 8, filter bag 9 and wheels 10 supporting the housing 1. The self-propelled swimming pool cleaner can include features known to the prior cleaning apparatus which are moved by the directional control of one or more water jets and valves, such as the apparatus and methods described in commonly assigned U.S. Pat. Nos. 7,827,643, 7,316,751, 7,165,284, 6,971,136, 6,742,613, 6,412,133, the disclosures all of which are incorporated herein by reference in their entirety.

Figure 2:
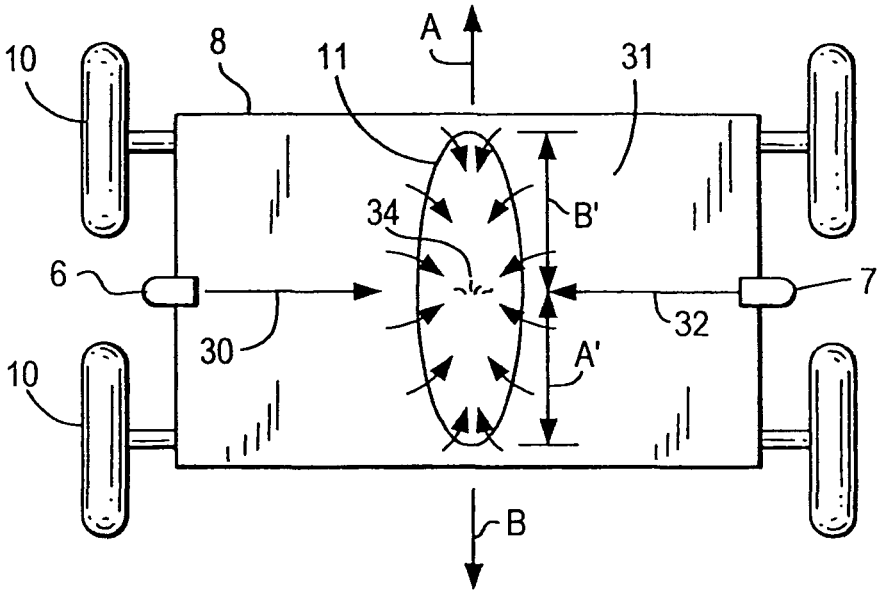
FIG. 2 is a bottom view of the pool cleaner, taken on lines 2-2 of FIG. 1.

As further illustrated in FIG. 2, the water jets 30, 32, are supplied by the centrifugal pump 3 and discharged by the jet nozzles 6, 7, respectively, are directed toward the dirt and debris 36 on the pool surface below the baseplate 31. The baseplate 31 is provided with an oval-shaped aperture forming an intake port 11. The intake 11 is oriented in a front and a back direction, relative to the longitudinal orientation of the jet streams 30, 32, as illustrated in FIG. 2. The streams 30, 32 are aimed at the surface below the middle of the intake 11 so that the combined water flow from the streams 30, 32 accommodates the intake 11 equally regardless of whether the cleaner moves forward or backward. In either case, the trailing half of the intake 11 is always the working half as the turbulence does not benefit the leading half. When the cleaner moves in the direction shown by arrow A, section A' of the intake 11 does most of the cleaning. Conversely, when the cleaner moves in the direction of arrow B, section B' of the intake 11 benefits from the turbulence by drawing the suspended debris and dirt into the filter bag.

Figure 6:
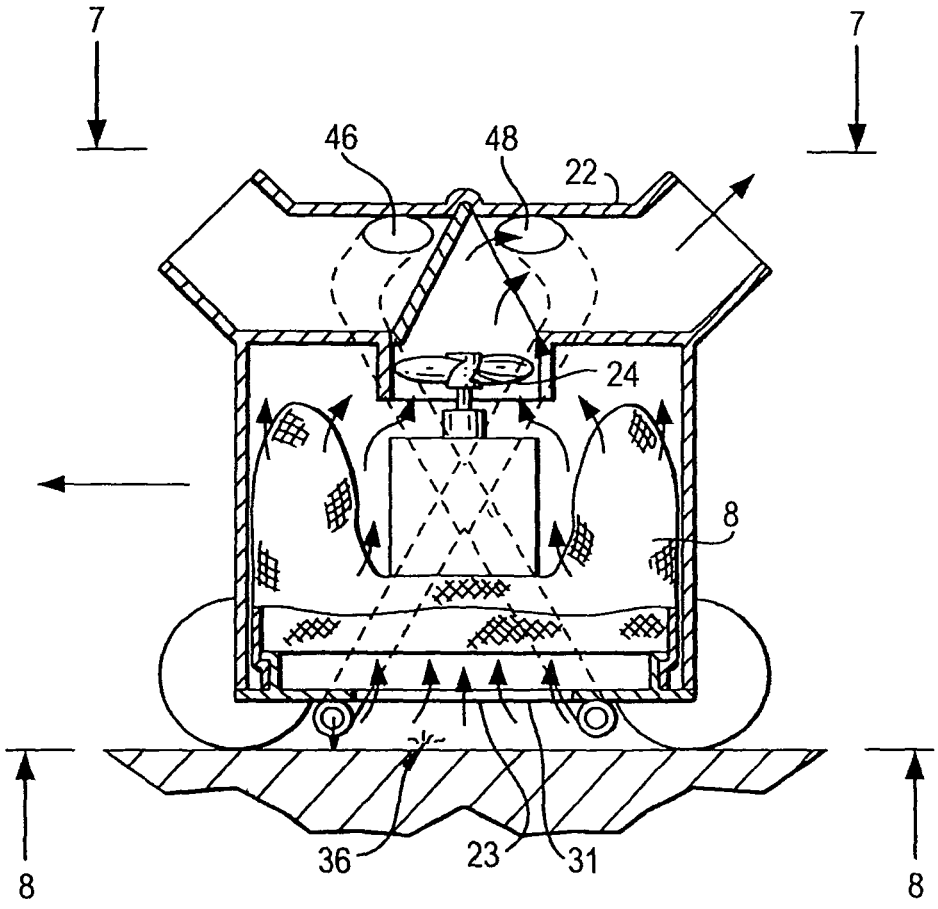
FIG. 6 is a side elevation view, partly in cross-section, of another embodiment of the invention utilized with a cleaner that is moved about the pool by water jet propulsion.

The pool cleaner of this embodiment can also be self-propelled, for example, using discharged water jets from a jet valve housing, such as the housing 22 shown in FIG. 6 as well as discharged water jets described in the incorporated U.S. Pat. No. 6,412,133 B1, employing the pressure from the discharged water jets to move the pool cleaner in selected directions controlled by water valves or other mechanisms. Alternatively, the wheels 10 can be connected to one or more drive motors for selectively moving the pool cleaner along the surface of the pool being cleaned. The drive motors can be electric or water turbine driven by pressurized water.

Although the embodiment shown in FIGS. 1-2 provides far better results than those of prior art pool cleaners, the performance and efficiency can be further improved, as will be described below.

Figure 3:
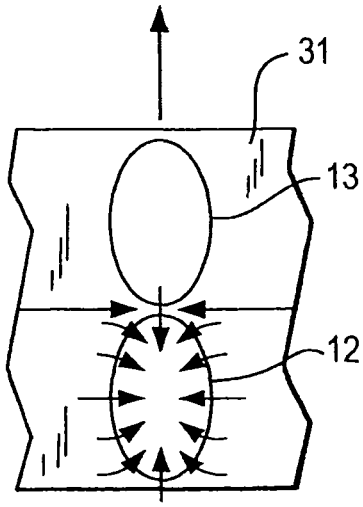
FIG. 3 is an alternative embodiment similar to that of FIG. 2.

In the second embodiment shown in FIG. 3, the one long intake opening of the intake 11 of FIG. 2 is replaced by two smaller openings 12 and 13, one of which is always closed, as by a solenoid switch or other means. Thus, the speed of the intake stream as indicated by the arrows can be doubled.

Figure 4:
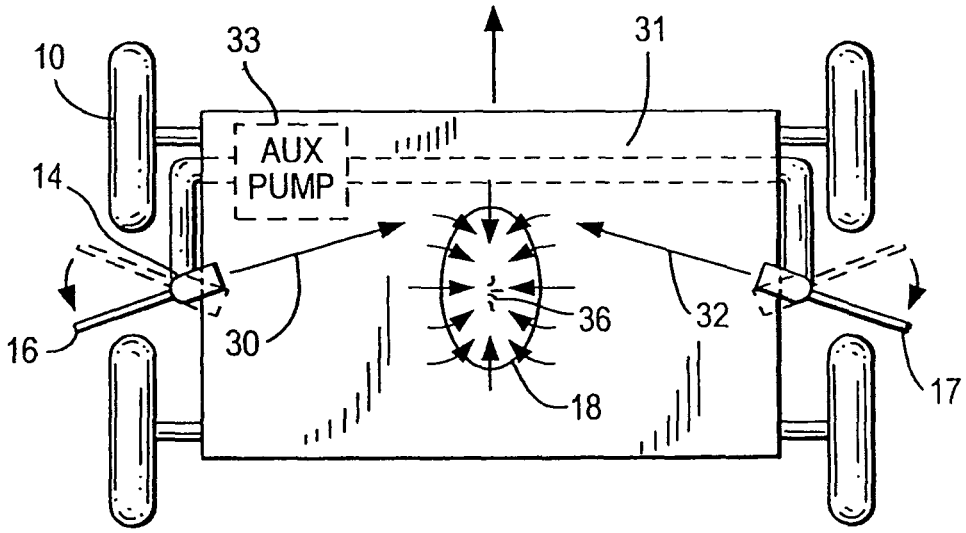
FIG. 4 is a bottom view of yet another embodiment of a pool cleaner similar to that of FIG. 1.

With reference to FIG. 4, there is shown yet another embodiment in which swiveling elbow jet nozzles 14 and 15 are equipped with fins 16 and 17, respectively, which automatically change the positions of the nozzles due to the force of the water, or water resistance, as the cleaner changes direction, to thereby always point to the upstream end of the intake 18. In the angular arrangement of the jet nozzles 14, 15 illustrated in FIG. 4, water is discharged at a predetermined pressure to move the debris 36 at a velocity that greatly reduces the relative speed between the debris 36 and the cleaner optimally to zero. This permits the cleaner to move at a relatively higher speed while the debris 36 is moved along in the same direction as the cleaner until the debris 36 can be drawn into the one or more intake port(s) 18 in the baseplate 31. An optional auxiliary pump 33 can also be used to boost the pressure provided by the streams 30, 32.

Figure 5:
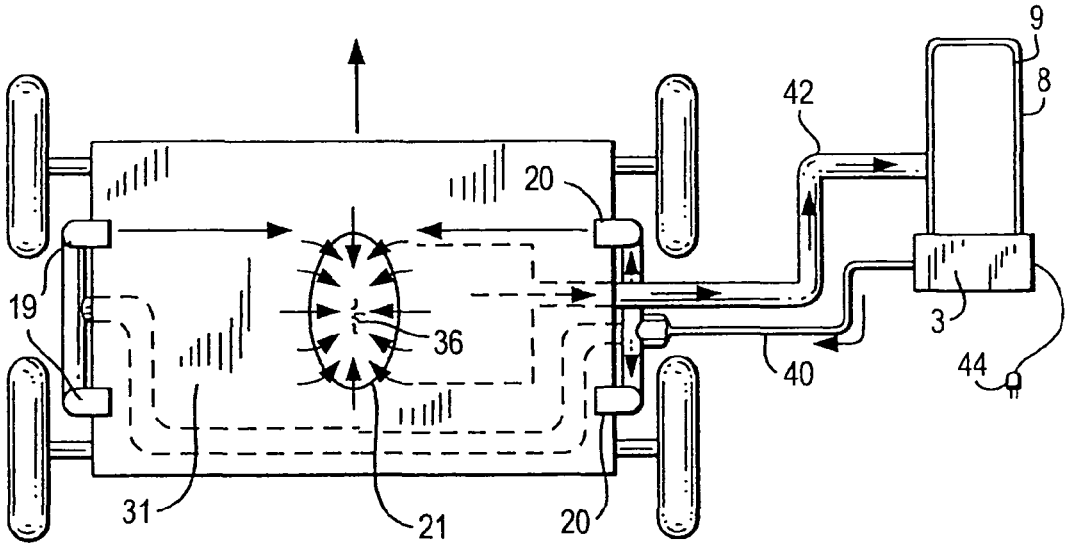
FIG. 5 illustrates a bottom view of yet another embodiment of the invention.

As shown in FIG. 5, another embodiment of the pool cleaner is provided with two pairs of directional nozzles 19 and 20 aimed at the front and rear portions of the intake port 21. A pair of solenoid activated valves (not shown) control the "on" or "off" flow condition of the nozzles 19, 20. In this embodiment, the centrifugal pump 3, the filter bag holder 8, and the filter bag 9 can be positioned external to the pool cleaner. The directional nozzles 19, 20 receive the water jet streams from an output tube 40 of the externally located centrifugal pump 3, and the filter bag 8 receives the intake water and debris 36 via the filter input tube 42. The centrifugal pump 3 is connected to an external power supply (not shown) by an electrical connector such as an electrical plug 44.

Figure 7:
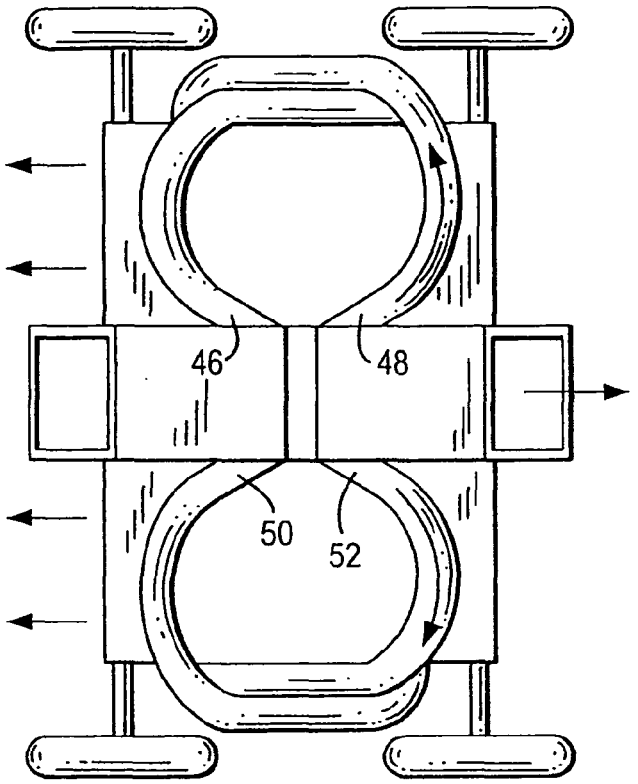
FIG. 7 is the top plan view of the cleaner taken along lines 7-7 of FIG. 6.
Figure 8:
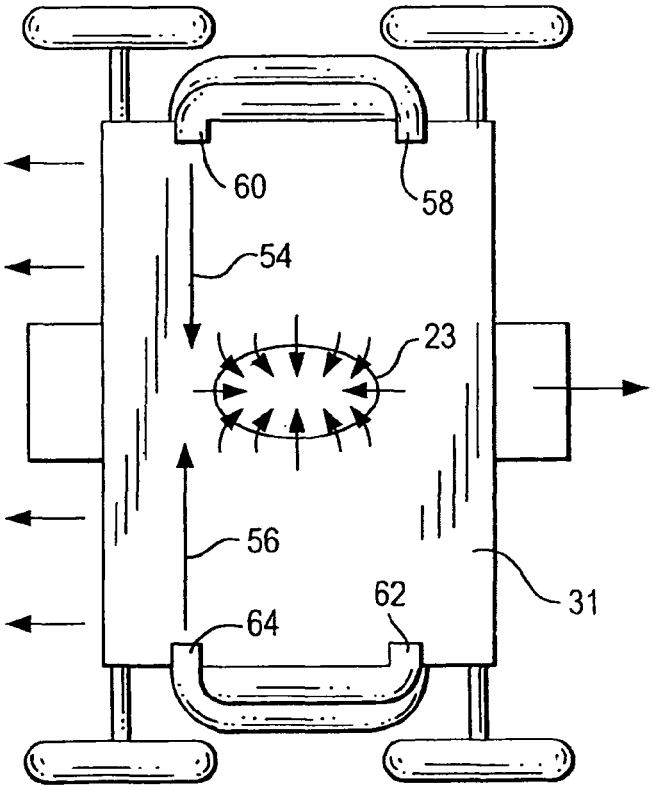
FIG. 8 is a bottom view of the cleaner taken along lines 8-8 of FIG. 6.

FIG. 6 is a side elevation view, partly in cross-section, of another embodiment of the invention fitted to a cleaner that is moved about the pool by water jet propulsion. In this embodiment, the jet valve housing 22 is tapped at four places 46, 48, 50, 52, shown in FIG. 7, to supply the plurality of water jet streams 54, 56 emitted from jet nozzles 58, 60, 62, 64, respectively, as best shown in FIG. 8. Those plurality of water jets function as described above to aid in the movement of dirt and debris 36 toward the intake port or ports in the baseplate 23. This embodiment operates in the same manner as the cleaner of FIG. 4, except that the change from one set of nozzles to the other set, such as the first pair 58, 62 of nozzles to the second pair 60, 64, is accomplished automatically in the jet valve housing 22 when the cleaner changes direction. This construction and method of operation eliminates the need for electronics to operate a solenoid controlled valve and provides a simple mechanism to perform the dual functions of directional control change and the flow to selected positions among the plurality of directionally oriented cleaning water jet nozzles 58, 60, 62, 64.

Figure 9:
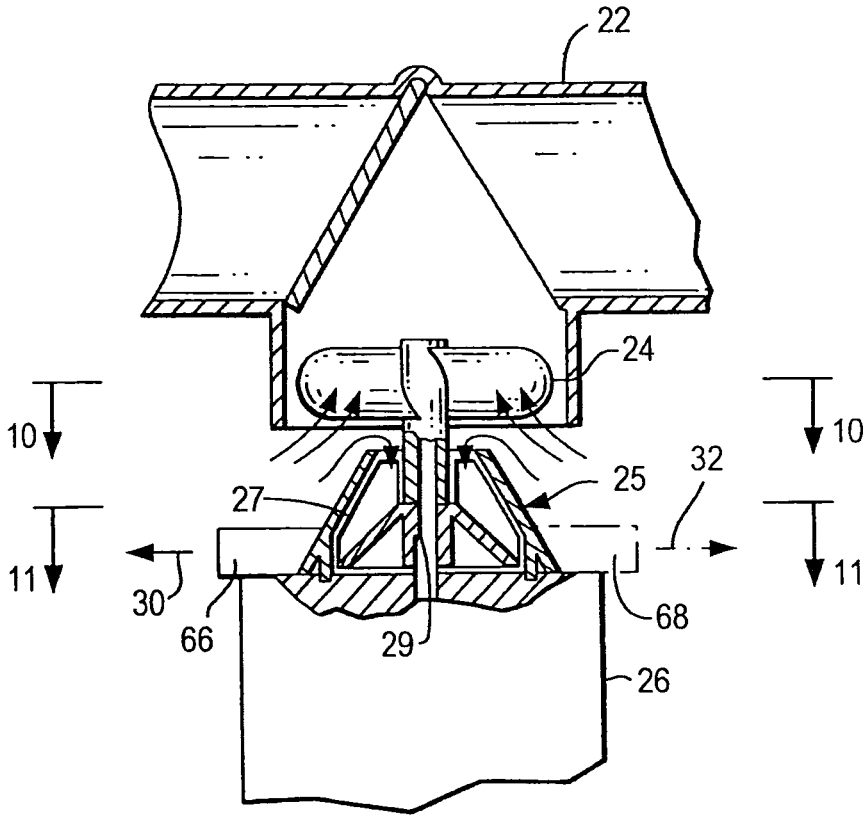
FIG. 9 is a side elevation, partly in cross-section, of yet another embodiment of the invention.

Referring to FIG. 9, a propeller pump 24 and a centrifugal pump 25, functioning as an impeller, are operated by the same motor 26 for use in each of the embodiments shown in FIGS. 1-5. The centrifugal pump 25 is designed to have the shape of a cone to provide the least amount of resistance to the water being pumped by the propeller pump 24. The cone-shaped propeller base 27 also provides easier transition of water going through the impeller housing 28. The cross-section of the impeller blades of the propeller pump 24 corresponds to the cross-section of an airplane wing. This configuration helps to further limit the drag which the impeller puts on the motor shaft 29.

Figure 10:
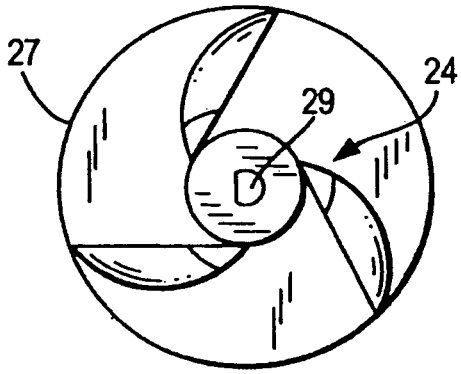
FIG. 10 is a top plan view of the impeller taken along lines 10-10 of FIG. 9.
Figure 11:
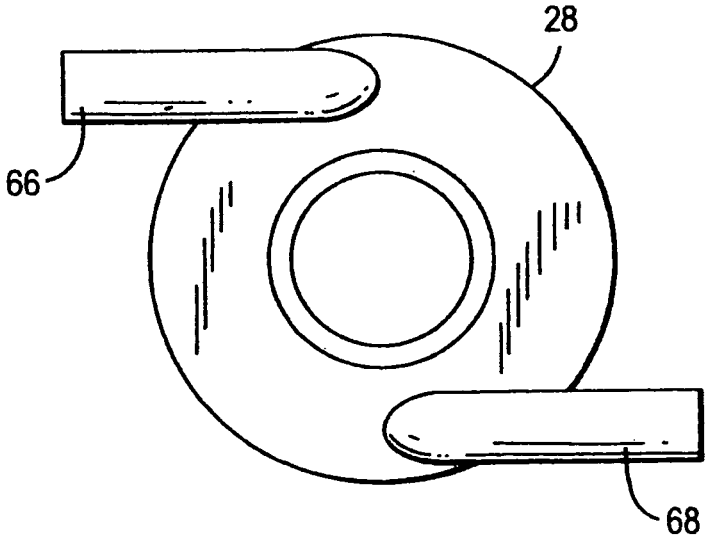
FIG. 11 is a top plan view of the impeller housing taken along lines 11-11 of FIG. 9.

With reference to FIG. 10 and FIG. 11 there is shown the water jet streams 30, 32 emitted from output channels 66, 68, respectively, which are connected to the connecting tubes in the various embodiments, such as the connecting tubes 4, 5 in FIG. 1. Having a centrifugal/impeller pump 25 coupled with a propeller pump 24 is also beneficial for other applications used to control the directional movement of a cleaner. For example, a hydraulic piston, which is normally operated pump powered by a small DC motor to arrest one side of moving cleaner, can be operated without the cost of the DC motor.

Figure 12:
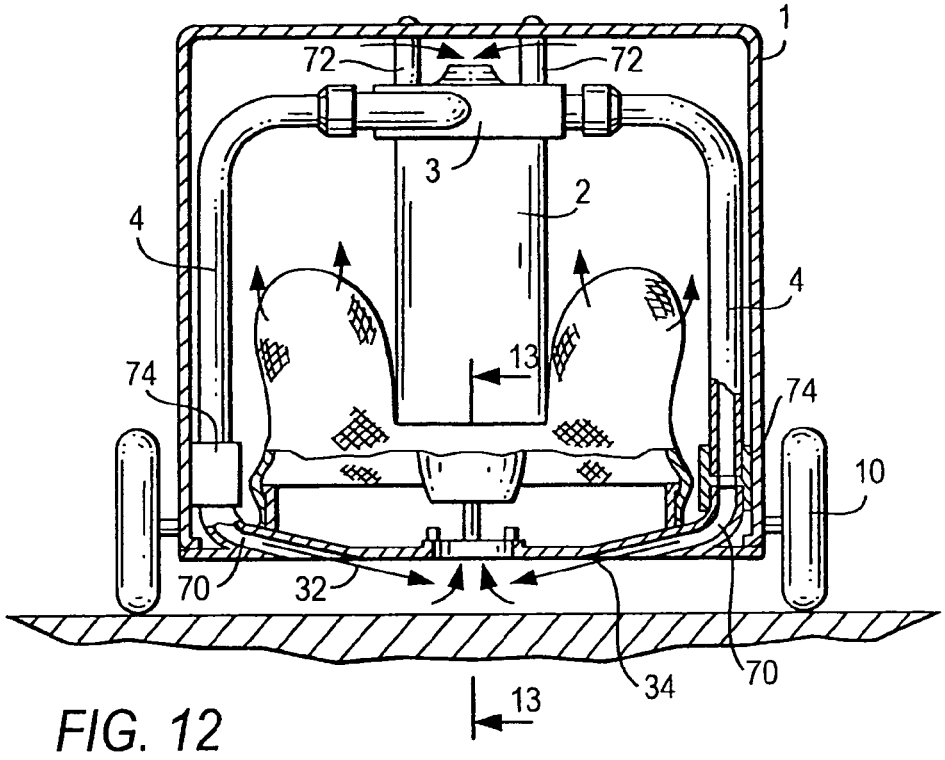
FIG. 12 is a cross-sectional view of a manually propelled pool cleaner in which the water jet delivery tubes are shown partly in section.

In FIG. 12, there is illustrated in a cross-sectional view, a manually propelled cleaner that is equipped with a bottom or baseplate 76 intake assembly which has a pair of water jet nozzles 70 permanently mounted at its opposite ends. The cleaner is also fitted with a centrifugal pump 3 that is secured to housing 1. In this embodiment water delivery tubes 4 are positioned inside the housing 1. Inner ends of the jet nozzles 70 are slidably connected to delivery tubes 4 by couplings 74 that are also mounted inside the main housing.

Baseplate 76 intake assembly has an elongated slot 11 perpendicular to the direction of the adjacent water jets. Inside, covering the slot 11 are a pair of flaps 78 that open when suction pump 3 is on and close when power is turned off.

Figure 13:
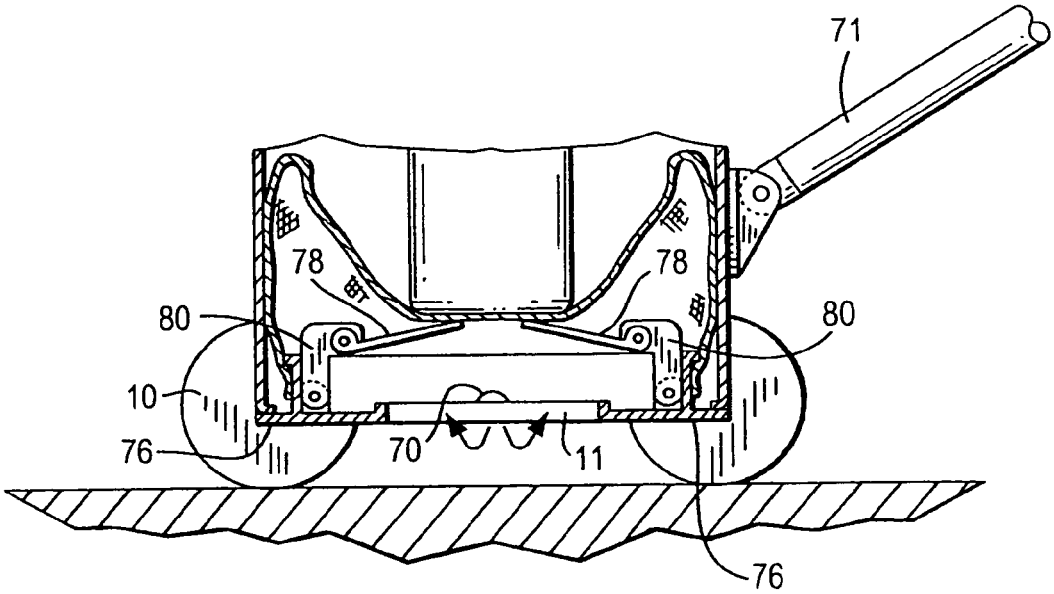
FIG. 13 is a segment of a cross-sectional view taken along line 13-13 of FIG. 12 showing intake flaps in the open position.
Figure 14:
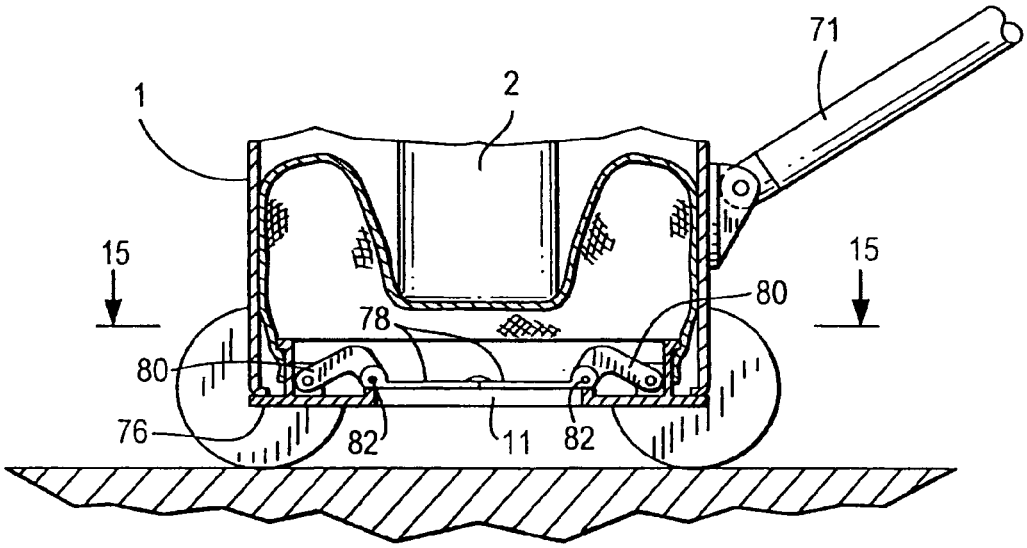
FIG. 14 is a view similar to FIG. 13 in which the intake flaps are in the closed position.

FIG. 13 illustrates a double pivot hinge mechanism having an "L" shaped hinge transfer member 80 connected to each flap 78. This allows the flaps 78 to lift off the slot 11 higher at their hinged ends than would otherwise be possible. This relationship and the functioning of the hinge members 80 are further illustrated in FIG. 14 where the flaps are shown in closed position. In the embodiment of FIGS. 12-15, the cleaner is manually propelled by handle 71.

Figure 15:
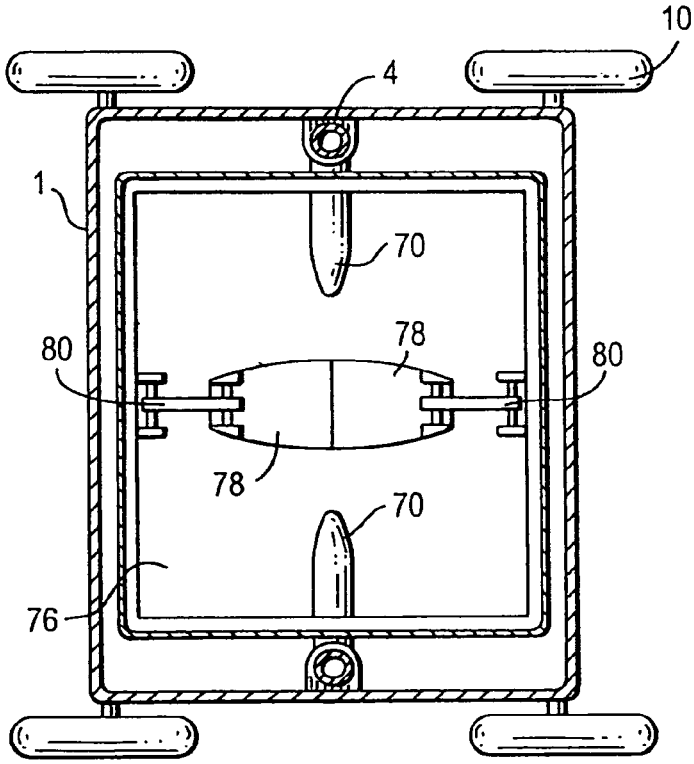
FIG. 15 is a cross-sectional view taken along line 15-15 of FIG. 14.

In the interior cross-sectional view of FIG. 15, the flaps 78 are shown in the closed position, each flap supported by a single hinge member 80. As will be understood by one of ordinary skill in the art, two or more hinge members 80 can be employed should the size of the intake 11 and/or flaps 78 be increased. The pivot means 82 permit the flaps to move easily in response to the water pressure during flow to settle in the closed position.

Figure 16:
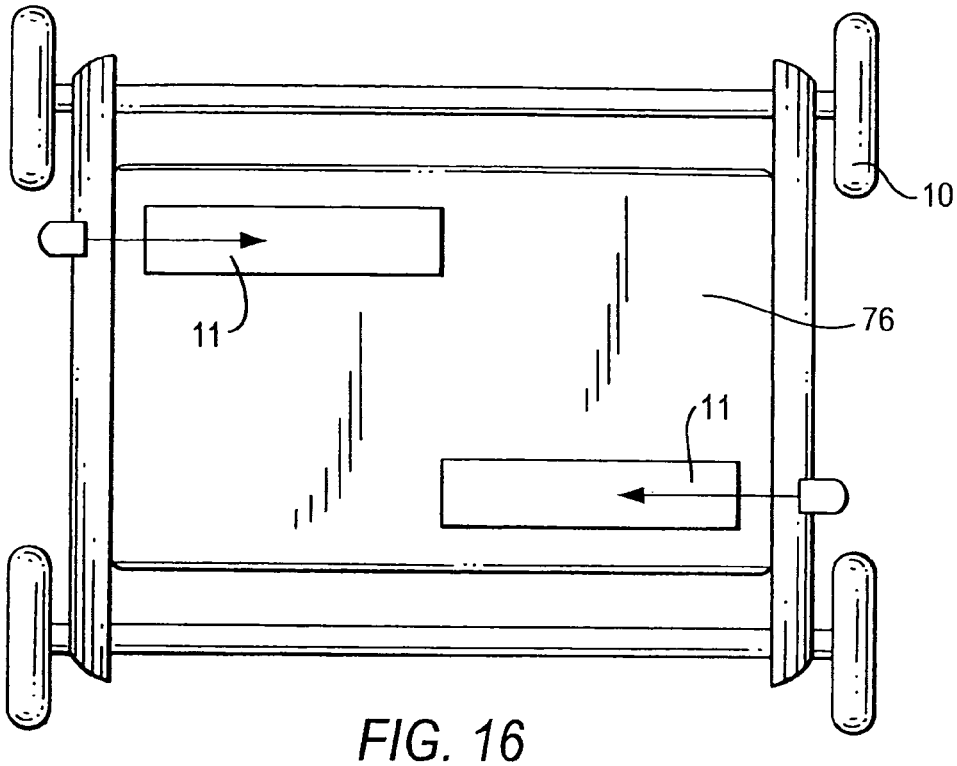
FIG. 16 is a bottom view of another embodiment of a pool cleaner fitted with the water jet cleaning system of the invention.

FIG. 16 is a bottom view of another water jet assisted cleaner that is equipped with a conventional baseplate intake assembly in which the major axis of the intake slot is parallel to the direction of their respective associated water jets. Although the direction of the slots are not in an optimum angle (front and back), the cleaning efficiency is still greatly increased when water jets are introduced to assist in raising the dirt and debris into suspension below the moving cleaner.

Figure 17:
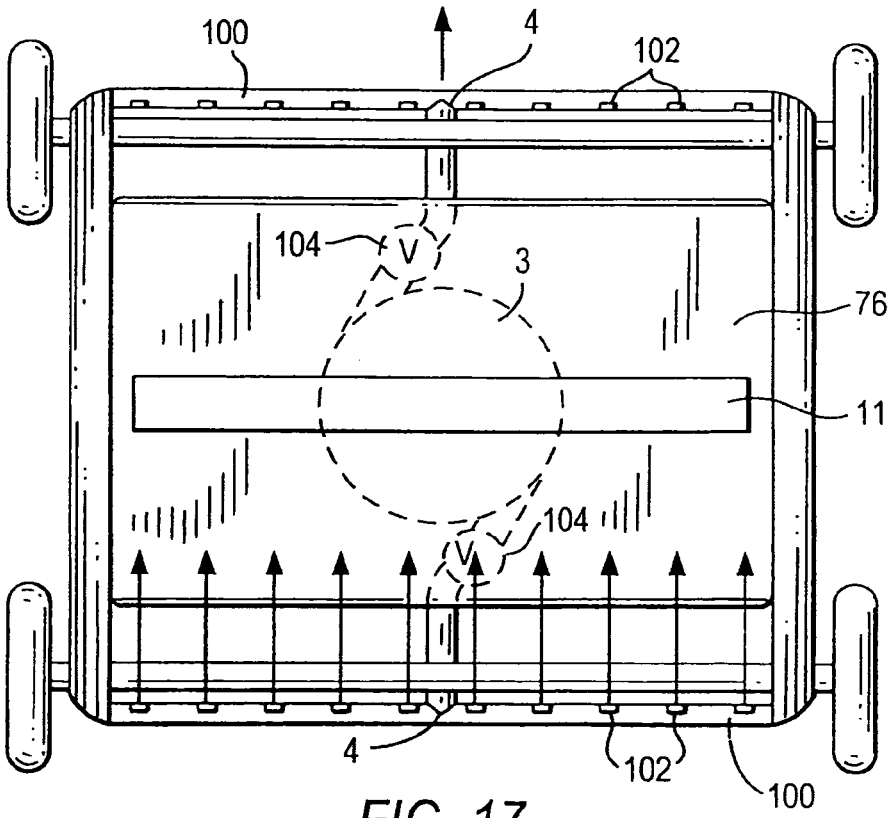
FIG. 17 is a bottom view of a pool cleaner equipped with a further embodiment of the invention.

FIG. 17 is a bottom view of yet another cleaner in which the intake slot is perpendicular to the movement of the cleaner and a pair of manifolds 100 are located parallel to the intake slot 11 in the front and back ends of the cleaner to provide multiple jet streams through a number of small water jet discharge openings 102 along the length of the manifold, aiming slightly down, but mainly toward the intake slot 11. In this embodiment, the single intake slot 11 extends substantially across the baseplate. A pair of valves 104 control the water flow from centrifugal pump 3 so that only the trailing manifold is activated, sweeping the debris forward, along with the moving cleaner, until it is picked up with water drawn into the intake slot 11. In a preferred embodiment, each of the discharge openings 102 is provided with a low friction fitting to minimize the back pressure in the system and enhance the turbulent effect of the water stream to suspend dirt and debris.

An additional benefit of this arrangement is that the cleaner can clean very close to a sharp-cornered vertical pool wall. Although the plurality of water jet streams trail the moving cleaner, when the cleaner stops at the wall and reverses its direction, the trailing manifold begins sweeping the swimming pool floor close to the vertical wall.

In another embodiment of the manifolds of FIG. 17 (not shown), of the control valves, are omitted, leaving open the flow path to both delivery tubes and manifolds. Although the front water jets will be sweeping the debris backwards against the directional movement of cleaner, the rear water jets sweeping forward trap debris under intake port 11 until it is picked up.

Figure 18:
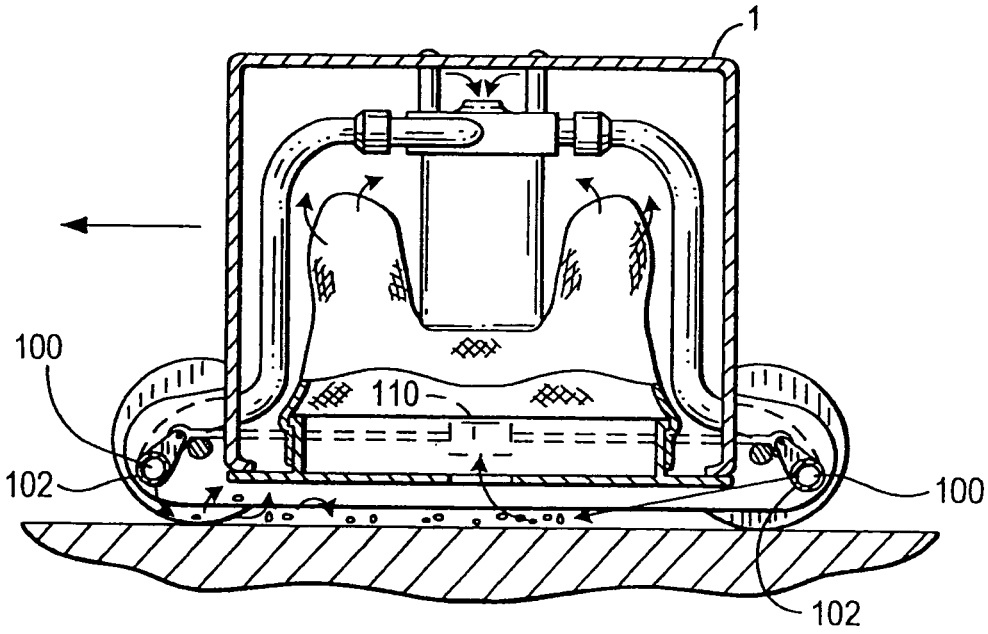
FIG. 18 is a cross-sectional side elevation view of a further embodiment of the invention.

Referring to the embodiment of FIG. 18, valves controlling the water jet manifolds are replaced by solenoids 110 which automatically turn a pair of swiveling manifolds 100 so that the leading manifold's water jets 102 are aimed substantially downward, stirring up the debris, while the trailing manifold's water jets are aimed substantially forward, sweeping the debris along with the moving cleaner. Both manifolds are open at all times.

Figure 19:
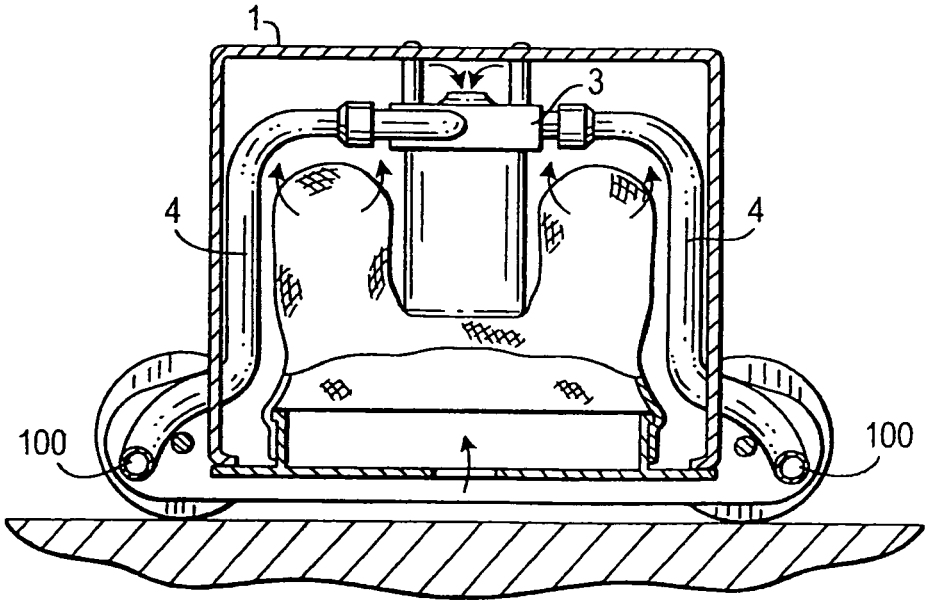
FIG. 19 is a cross-sectional side elevation view of another simplified embodiment of the invention.

With reference to FIG. 19, there is illustrated an embodiment in which both manifolds 100 are in a fixed position with their water jets aimed substantially downward. Although this fixed positioning of the water jets may not be as efficient in cleaning as those described above, it will outperform prior art cleaners that are not assisted by water jets. The elimination of electronics components that are necessary to operate solenoids and/or other automatic switching mechanisms makes this embodiment of the invention particularly cost-effective to produce.

Figure 20:
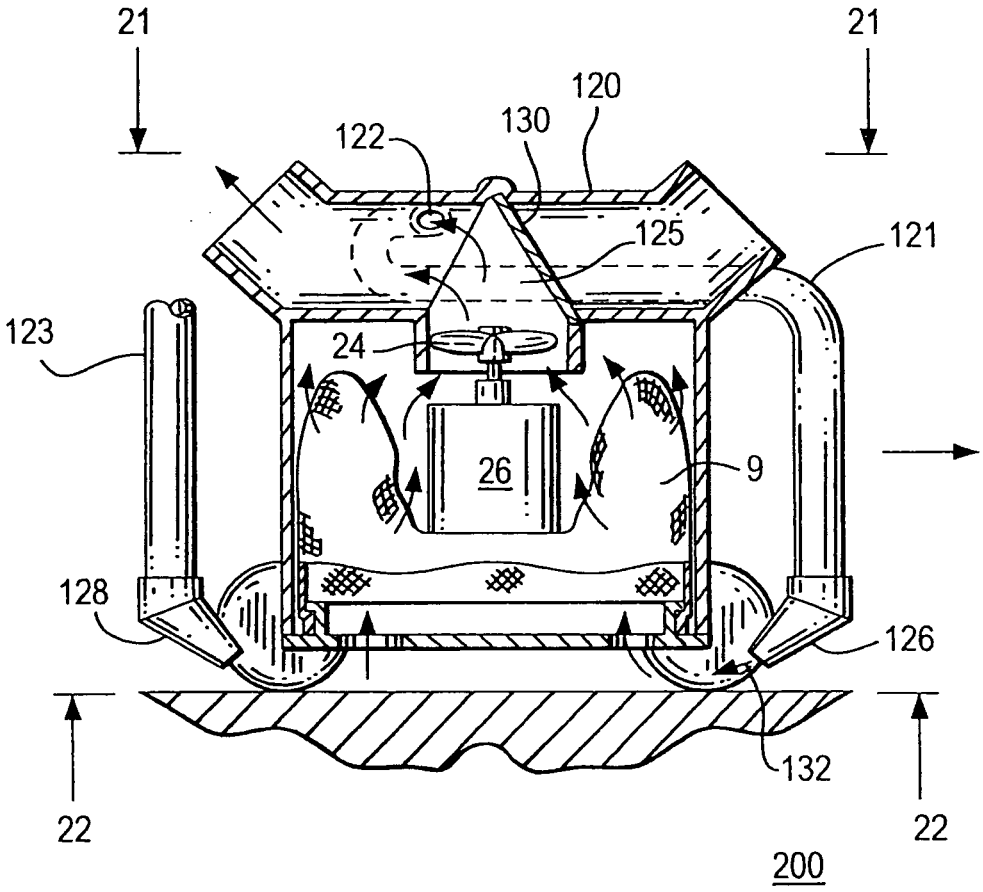
FIG. 20 is a side elevation view partly in cross-section of another embodiment of the invention utilized with a cleaner that is moved about the pool by water jet propulsion.
Figure 21:
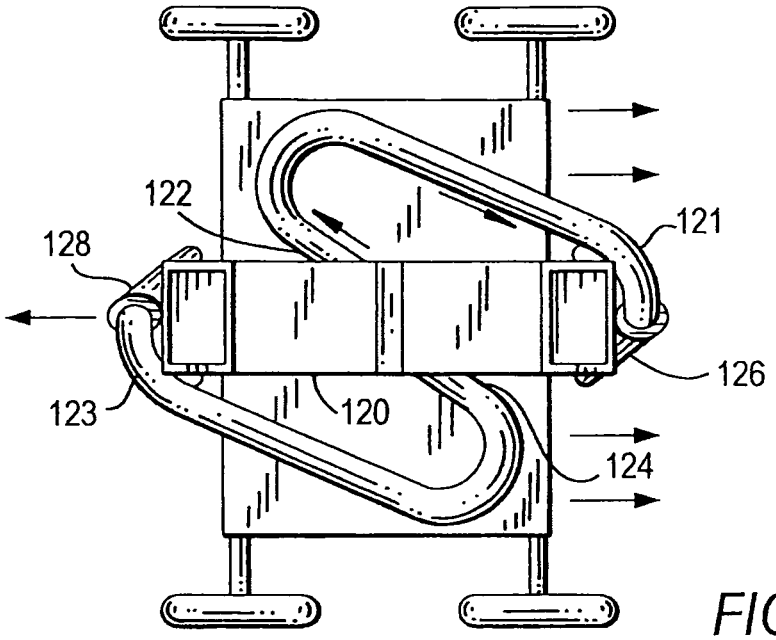
FIG. 21 is a top view of the cleaner of FIG. 20 taken along line 21-21.
Figure 22:
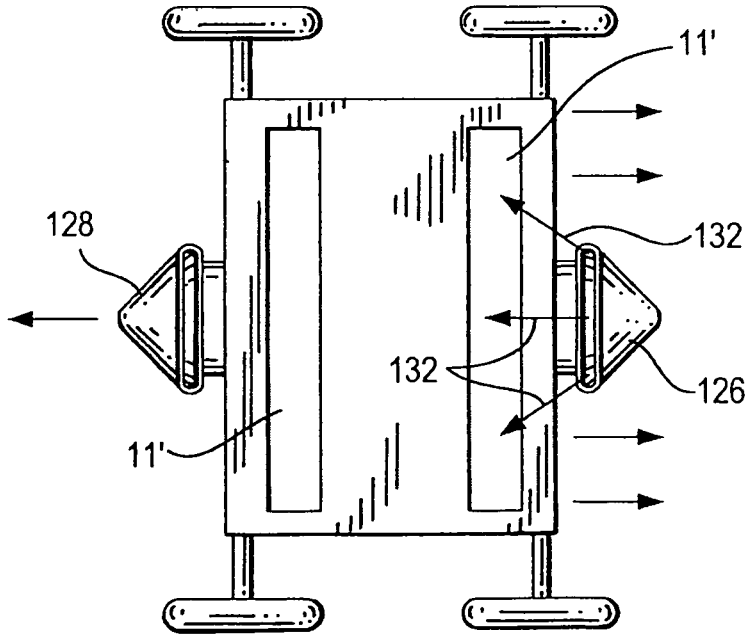
FIG. 22 is a bottom view of the cleaner of FIG. 20 taken along line 22-22.

Referring now to FIGS. 20-22, the jet valve housing 120 of a cleaner 200 is tapped at two ports 122 and 124 to supply water jet streams to the opposing ends of the cleaner. The jet valve housing port 122 is coupled to nozzle 126 via connecting tube 121. Similarly, the jet valve housing port 124 is coupled to nozzle 128 via connecting tube 123.

The front and rear ends of the cleaner are defined by the direction of movement of the cleaner. As illustratively shown in FIG. 20, the cleaner 200 is moving to the wall of the pool on the right. Therefore, the right side of the cleaner 200 is considered the front end and the left side is considered the rear end of the cleaner. Likewise, the left side of the cleaner is considered the front and the right side is considered the rear when the cleaner is moving in the opposite direction.

The ports 122 and 124 are at diametrically opposite sides of jet valve flap 130 and outside of the jet valve chamber 125, so that only one of them is able to supply pressurized water to its respective nozzle at a time because the jet valve flap 130 is blocking the other. Thus, it is assured that the nozzle 126 at the front end of the cleaner 200 provides a "V"-shaped cleaning jet stream 132 that directs the water borne debris 36 towards the front intake 11 of the cleaner.

For example, referring to FIG. 20, the jet valve flap 130 is shown in a first position to the right. The pressurized jet stream 132 from the pump 3 is directed through the jet valve housing 120 to the left to cause the cleaner to move forward towards the right, as described above with respect to FIGS. 6-11. A portion of the pressurized water generated by the pump 3 exits the jet valve housing 120 via port 122, which in turn flows through the connecting tube 121 and out nozzle 126 as a cleaning jet stream 132. The nozzles 126 and 128 are positioned longitudinally along the front and rear portions of the cleaner. Referring to FIGS. 21 and 22, nozzle 126 extends parallel to the intake port 11. Similarly, nozzle 128 extends parallel to the intake port 11'.

Advantageously, the embodiment of FIGS. 20-22 does not require an additional centrifugal pump to provide the cleaning water jet. Moreover, the pump 3 is able to pass more water through the pair of nozzles 126 and 128 via the connecting tubes 121 and 123, respectively, since there is less of a load as compared to the embodiment illustrated by FIGS. 1-5 and 9. Further, the present embodiment shown in FIGS. 20-22 provides a water jet only in the front end (direction of movement) of the cleaner, such that more water is concentrated to lift the debris 36 into suspension for subsequent passage into the forward intake port 11 of the cleaner 200 and entrainment in the filter 9.

Figure 23:
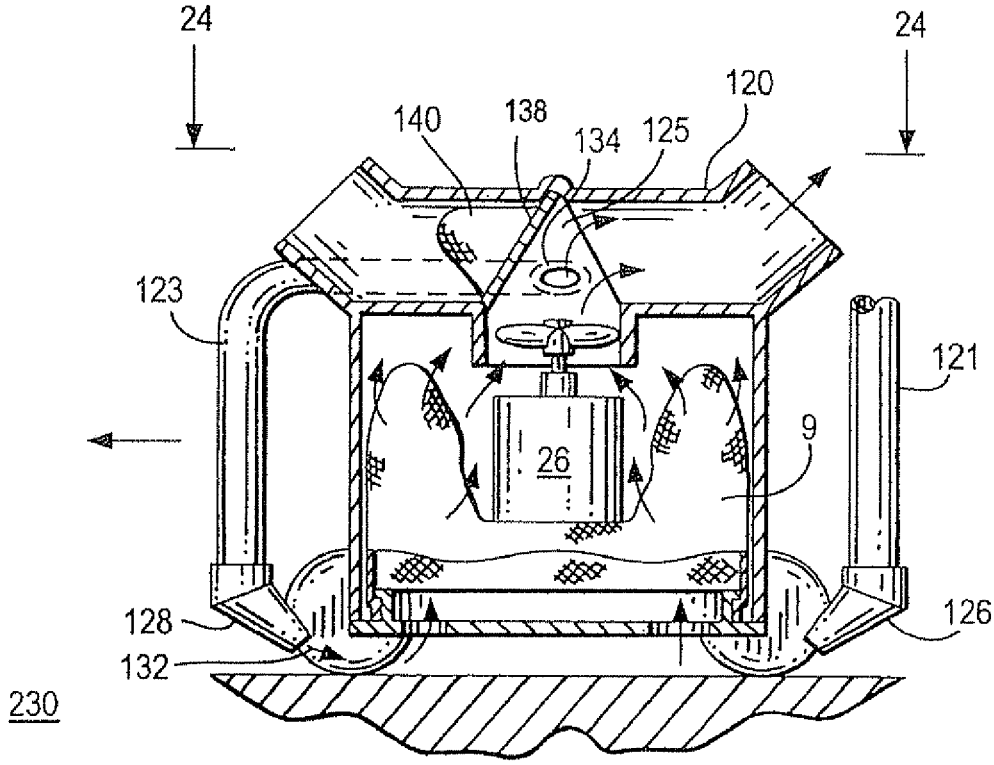
FIG. 23 is a side elevation view partly in cross-section of yet another embodiment of the invention used in a cleaner that is moved about the pool by water jet propulsion.

Referring to FIG. 23, this embodiment of a cleaner 230 is similar to that which is shown in FIGS. 20-22, except that the ports or taps 134 and 136 are positioned centrally in the side wall of the jet valve chamber 125 of the jet valve housing 120. Specifically, referring to FIGS. 20-22, the ports or taps 122 and 124 are positioned outside or downstream of the jet valve chamber 125, while the ports 134 and 136 of the embodiment of FIG. 23 are located on the sides at or near the center of the jet valve chamber 125.

Figure 25:
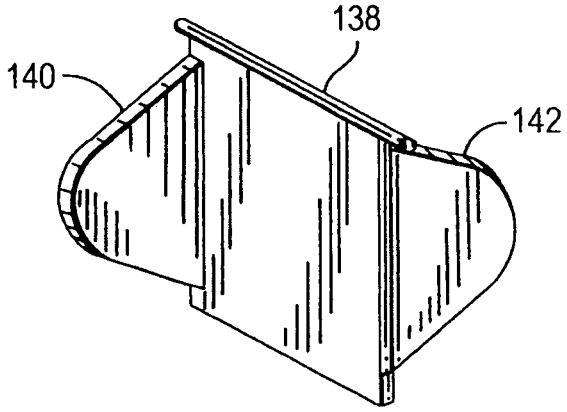
FIG. 25 is a perspective view of a water jet directional valve for use in cleaner of FIG. 23.

Referring to FIG. 25, the jet valve flap 138 is planar and includes diametrically opposing first and second flanges 140 and 142. The first flange 140 extends substantially perpendicular and from a first side of the jet valve flap 138 in the longitudinal direction of the cleaner 230. Similarly, a second flange 142 extends substantially perpendicular and from a second side of the jet valve flap 138 in the longitudinal and opposite direction of the first flange 140. The configuration of the ports 134 and 136 along the center of the jet valve chamber 125 and the shape of the jet valve flap 138 ensures that regardless of which side of the jet valve flap 138 is positioned, one of the ports 134 and 136 is always open, while the other port is closed.

Referring to FIG. 23, the cleaner 230 is illustratively shown moving towards the left in a forward direction. The jet valve flap 138 is positioned to the left of the jet valve chamber 125 such that flange 140 is displaced from port 134, thereby leaving port 134 open to allow the jet stream 132 to flow through tube connector 123 and out nozzle 128 along the forward direction of the cleaner 230. Although not shown in FIG. 23, a person skilled in the art for which the invention pertains will understand that flange 142 (FIG. 25) is concurrently positioned over the opposing port 136, such that the jet stream is precluded from flowing through connector tube 121 and nozzle 126 along the rearward direction of the cleaner 230.

When the pool cleaner 230 moves to the right in a new forward direction opposite the previous direction as a result of the pivotal movement of the jet valve flap 138 to the right, the flow of pressurized water from the pump 3 will flow through connecting tube 121 and out nozzle 126. Further, flap 140 will occlude port 134 and prevent the flow of the pressurized water through connecting tube 123 and out nozzle 128.

Figure 24:
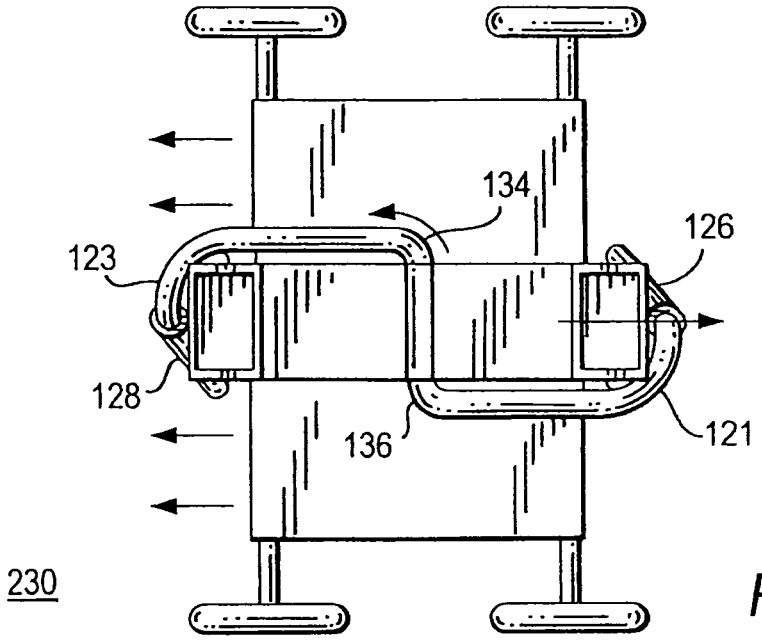
FIG. 24 is a top view of the cleaner of FIG. 23 taken on line 24-24.

The configuration of the jet valve flap 138 of FIGS. 23-25 advantageously permits the use of shorter and more compact water jet tubes 121 and 123. It will be clear to one of ordinary skill in the art from this description that the embodiment illustrated in FIGS. 23 and 24 can also be implemented with a conventional jet valve flap 130 (FIG. 20), in which event both front and rear cleaning jets are operational concurrently. The advantage of this design is a simpler jet valve and jet valve housing 120. The speed at which the cleaner moves around the pool is reduced somewhat, because the forward and backward force created by the water cleaning jets 132 oppose each other. However, the dual water jets 132 will further enhance the stirring up of debris 36 for intake and filtration by the cleaner 230.

It is also highly desirable that the robotic pool cleaner to be able to climb the vertical walls of a pool, even at sharp corners of ninety degrees. This embodiment is described below with reference to FIGS. 26-28.

Referring to FIG. 26, an embodiment of a cleaner 260 is illustratively shown in position at a vertical wall of the pool. The cleaner is similar to the cleaner embodiments shown in FIGS. 20-25, where the front and rear nozzles 149 and 149' are positioned longitudinally forward and rearward of the intake ports 11 and 11'.

The cleaner 260 includes a pair of spring-loaded levers 144 and 144' which are positioned on one side of the housing 1. The spring-loaded levers 144 and 144' form a generally obtuse angle and pivot about the apex pivot points 146 and 146' at which the levers 144 and 144' are movably attached to the side of the housing 1. A first end of each lever 144, 144' includes a roller 148, 148', which extends a predetermined distance in the longitudinal direction beyond the housing 1. The rollers 148 and 148' are mounted to the first end of the levers 144 and 144' by a pin, fastener, or other known manner that enables the rollers to rotate unimpeded.

A pair of cross-members 163 and 163' extend across the front and rear portions of the housing 1, respectively, i.e., perpendicular to the levers 144 and 144'. In one embodiment, the cross-members 163 and 163' are L-shaped having first and second legs. Alternatively, the cross-members 163 and 163' can be formed by two separate structural members (e.g., rods) or by a C-shaped member that is rotatably attached to opposing sides of the housing 1.

Referring to FIG. 27, the first leg of cross-member 163 is coupled to lever 144 and extends along the forward direction of movement (front) side of the housing and over the nozzle 149. The second leg extends a distance and is rotatably attached along the housing 1 on the side opposite where the lever 144 is positioned. Similarly, the first leg of cross-member 163' is coupled to lever 144' and extends along the rearward direction of movement (rear) side of the housing 1 and over the nozzle 149'. The second leg extends a distance and is rotatably attached along the housing 1 on the side opposite where the lever 144' is positioned.

Each nozzle 149 and 149' includes a spring-loaded deflector 154, 154' that is positioned over a first portion of the nozzle outlet. During the part of the operation when the cleaner is not climbing up or down a wall, the deflectors 154, 154' occlude the first portion of the nozzle outlets such that only a second portion of the nozzle outlet remains constantly open, as shown at nozzle outlet locations 152 and 152'. In one embodiment, the deflectors 154 and 154' are rotatably attached at a pivot point to the nozzles 149, 149', respectively. As described in further detail below, a deflector can be rotated or repositioned such that the first portion of the nozzle outlet is fully open, thereby permitting the flow of the jet stream 170 therefrom to enable the cleaner to initiate climbing up a side wall or initiate moving from the sidewall back onto the bottom surface of the pool.

In one embodiment, the second portion of the nozzle outlet 152 is directed at an angle (e.g., 45 degrees) towards the bottom surface of the pool and rearwards towards the intake opening 11. In this manner, the jet stream 170 flows from the connecting tube through the open nozzle outlet 152, 152' to stir up the debris for capture at the intake opening 11, as described above with respect to the embodiments of FIGS. 20-25.

Each cross-member 163 and 163' includes a protrusion or extension member 150 and 150' that is positioned over the nozzles 149 and 149', respectively. The protrusion 150 serves as lever or switch to push open the adjacent deflector 154 by coming into contact with the spring-loaded deflector 154. In particular, when the cleaner comes into contact with a vertical wall of the pool while traversing in a forward direction, the roller 148 and protrusion 150 both initially contact the wall of the pool contemporaneously. The pool cleaner's contact with the wall causes the roller 148 to rotate inward and downward in the longitudinal direction towards the cleaner housing 1, thereby causing the lever 144 to rotate upward about the pivot point 146.

In one embodiment, a reed switch 158 is attached to the housing proximate the inboard second ends of the levers 144 and 144'. Each second end of the levers 144 and 144' has a magnet 156, 156' mounted thereon. As shown in FIG. 26, when the pool cleaner contacts the vertical wall of the pool, the roller 148 causes the lever 144 to rotate about the pivot point 146, such that the magnet 156 on the second end of the lever 144 moves towards the reed switch 158. When the magnet 156 is in proximity to the reed switch 158, the magnetic field from the magnet causes the contacts to come together, thus completing an electrical circuit. The reed switch 158 is closed, and thus activated, to provide electrical current via an electrical circuit (not shown) to a solenoid 160 located proximate the jet valve housing 120. Although the electrical circuitry to the solenoid 160 is described using a reed switch with magnets, a person of ordinary skill in the art will appreciate that other types of switches can be used to provide an electrical signal and pass current to the solenoid 160.

The jet valve housing 120 includes valves 162 and 162' which are located proximate the opposing output ports of the jet valve housing 120. The valves 162 and 162' are coupled to each other by link 164 through arms 166 and 166', respectively. The solenoid 160 (e.g., an electromechanical solenoid)

controls the movement of the link 164, which in turn controls the opening and closing of the valves 166 and 166'.

Figure 28:
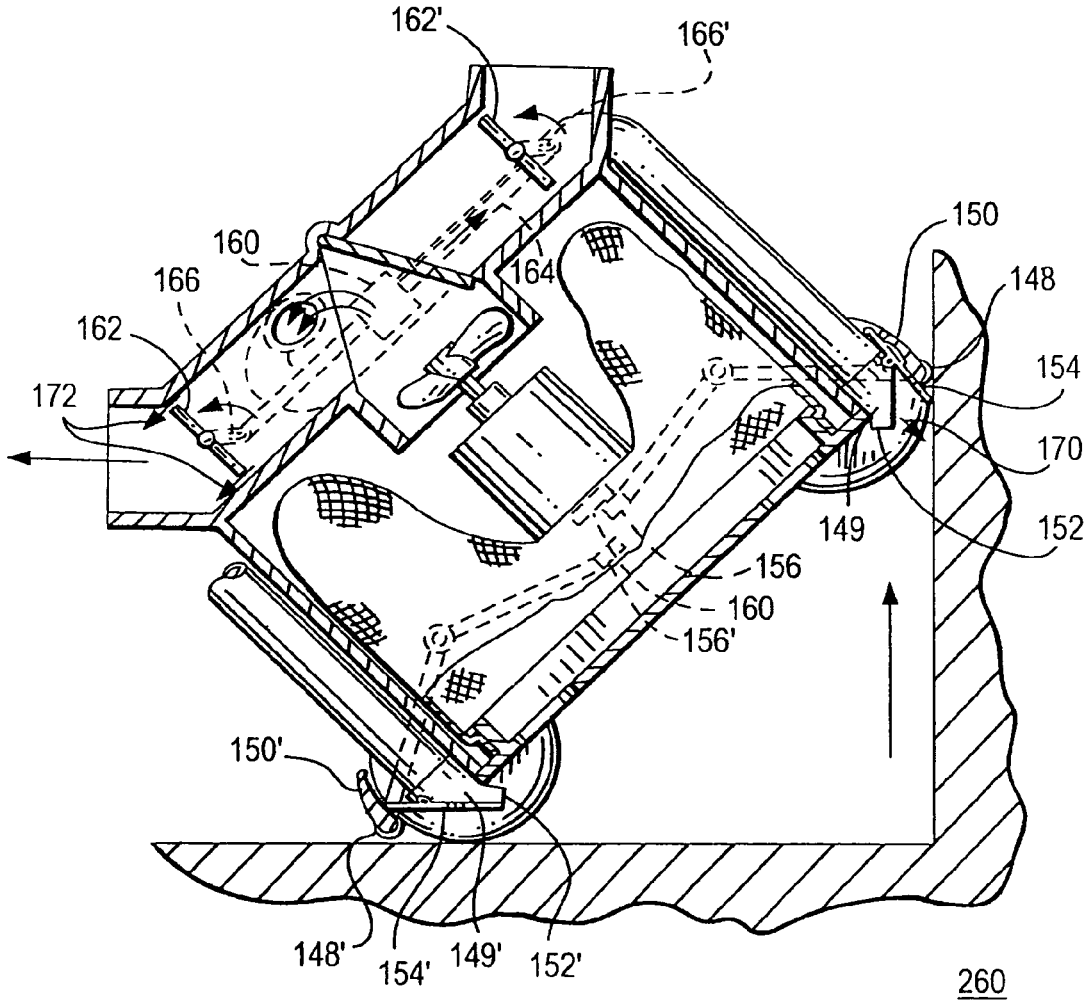
FIG. 28 is an illustration of the same embodiment as shown in FIG. 26 showing the cleaner as it is about to climb up a wall which is substantially perpendicular to the bottom of the pool.

Referring to FIG. 26, the valves 166 and 166' are shown as being open in the jet valve housing 120. Activation of the solenoid 160 causes valves 162 and 162' to rotate to a closed position. In particular, the valves 162 and 162' are linked at the opposing ends of link 164 through arms 166 and 166', respectively. When the electrical current produced by the reed switch 158 passes through the solenoid 160, a magnetic field is generated by the solenoid 160, which causes the link 164 to move laterally to rotate the valves 162 and 162', via the link arms 166 and 166'. The valves 162 and 162' are locked in the closed position as long as the solenoid is activated, i.e., generating the magnetic field. As shown in FIG. 28, once the valve 162 is closed, most of the water flows through the port or tap 168 and out the nozzle 149. Although the ports 168 and 168' are shown diametrically opposed to each other as provided in the embodiment of FIGS. 20-22, a person of ordinary skill in the art will appreciate that the opposed port arrangement and jet valve described in the embodiment of FIGS. 23-25 can also be implemented.

Further, when the roller 148 comes into contact with the wall of the pool, the protruding member 150 over the nozzle 149 also contacts the wall surface. The protruding member 150 is pushed backwards to contact one end of the spring-loaded nozzle deflector 154, thereby forcing the deflector 154 to rotate away from the first portion of the nozzle outlet 152. Once the first portion of the nozzle outlet 152 is open, the jet stream 170 can flow from the nozzle outlet 152 in a direction perpendicular to the bottom surface of the pool, which causes the front end of the pool cleaner to lift upwards. Although the deflectors 154 are shown and described as being opened and closed by the lever action of the protruding member 150, a person skilled in the art will appreciate that other electric and/or mechanical switching devices can be used, (e.g., solenoids).

Thus, the jet stream 170 from nozzle 149 has enough downward force to lift the front end of the cleaner 260. It is noted that the valve 162 is configured to allow for leakage of some water to insure that the rear wheels of the cleaner 260 continue to move in a forward direction toward the vertical wall, while the front wheels are rolling up the vertical wall.

As the cleaner 260 climbs the vertical wall of the pool and reaches an angle of approximately 45 degrees, the angle between the lever 144 and the vertical wall becomes approximately 90 degrees. At this position, the protruding member 150 no longer contacts the surface of the vertical pool wall. As the lever 144 rotates upward and away from the housing 1, the magnet 156 mounted on the second end of the lever 144 moves downward and away from the reed switch 158. Once the magnetic field of the magnet 156 is no longer in proximity of the reed switch 158, the reed switch 158 returns to its normally open state and thereby terminates electrical power to the solenoid 160. The cessation of power to the solenoid 160 unlocks the valves 162, 162' and allows the pressure from the flow of the water through the valve jet housing 120 to rotate valve 162 to an open position, as shown in FIG. 26. Because the valves 162 and 162' are linked via link 164, the valve 162' opens contemporaneously with opening of valve 162.

Approximately at the same time, the spring-loaded deflector 154 mounted over the first portion of the nozzle 149 rotates back to its closed position, such that only the second portion of nozzle outlet 152 remains open. The cleaner 260 resumes linear movement up the side wall and the jet stream 170 from the nozzle outlet 152 helps clean any debris 36 off the surface of the wall of the pool. Once the pool cleaner 260 reaches the upper portion of the wall of the pool, the cleaner 260 reverses direction and descends downward. The same operation occurs again at the opposite end of the cleaner when the cleaner 260 contacts the bottom surface of the pool to resume cleaning thereof.

Advantageously, the nozzle assembly of the embodiment of FIGS. 26-28 cleans a surface (e.g., bottom surface) of the pool, as well as includes a mechanism to lift the front end of the pool cleaner to an upright position to continue the cleaning process along a substantially perpendicular (e.g., side wall) surface of the pool. The implementation of the jet stream to lift the front end of the pool cleaner when confronting a perpendicular surface of the pool does not add any additional strain to the pump motor that drives the pool cleaner in the forward and reverse directions. Other advantages include no need for an auxiliary pump to activate additional jet valve that would be used to lift the front end of the cleaner.

In yet another embodiment, improvements in jet valve and housing design as it relates to water flow efficiency are illustrated in FIGS. 29-35. In the field of swimming pool cleaners, pumps are utilized to deliver high volumes of water so that heavier debris can be easily removed from the surfaces of the pool. In order to reduce the physical size and cost of these pumps, propeller pumps can be used instead of impeller pumps. Propeller pumps deliver high volumes of water at low pressures. Accordingly, for at least the present embodiment described below, the chambers and passages through which the water flows from the pump to the nozzles are advantageously provided with minimal turns, convolutions and obstructions to prevent unnecessary pressure drops and loss of flow volume.

Figure 29:
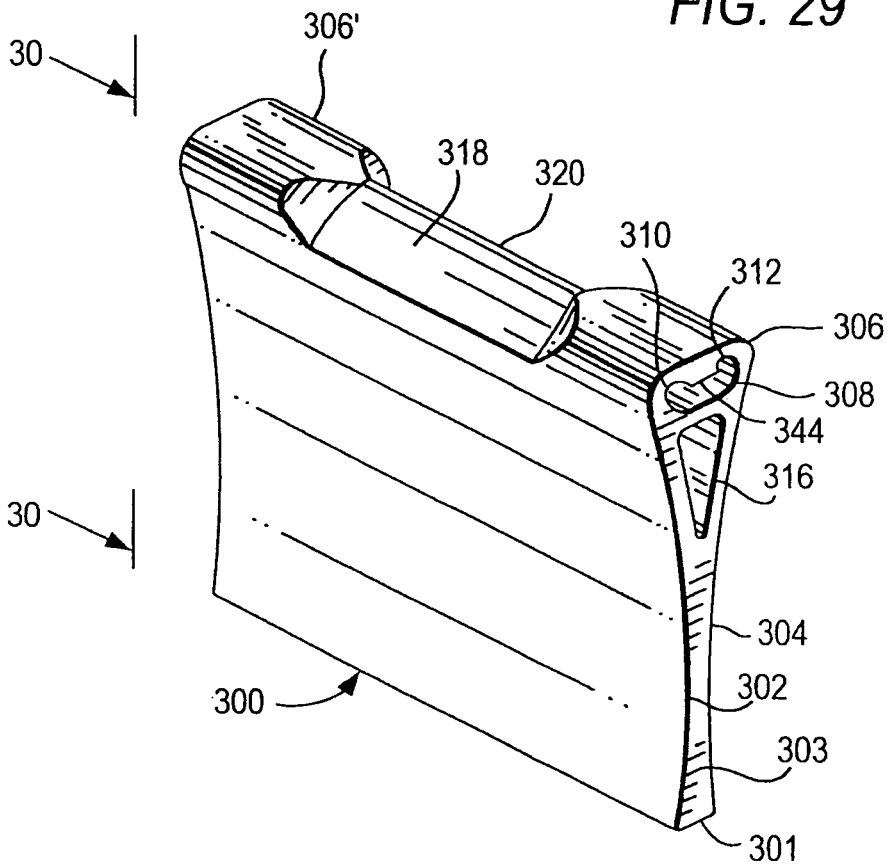
FIG. 29 is an isometric view of a streamlined jet valve.
Figure 30:
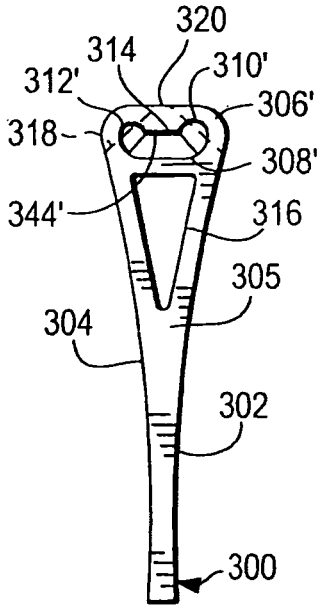
FIG. 30 is an end view of the valve taken on line 30-30 of FIG. 29.

Referring to FIGS. 29 and 30, there is shown an improved version of a jet valve flap 300. The jet valve flap 300 has opposing first and second walls 302 and 304 which are curved, e.g., concave in shape, so that when water is being propelled by the propeller up against a side wall (302 or 304) of the valve 300, the water goes through a smoother transition as it changes direction in jet valve housing. A sidewall 303 and 305 is formed along the opposing ends of the first and second walls 302 and 304.

Each side wall 303 and 305 includes upper shoulders 306 and 306' which house slots 308 and 308', respectively. Slots 308 and 308' extend perpendicular to side walls 303 and 305. At both ends of the slots 308 and 308', are formed a pair of pockets 310, 312 and 310', 312', respectively. The pockets 310, 312 and 310', 312' extend inward with respect to side walls 303 and 305, and are separated by inner shoulders (e.g., protrusions) 344 and 344', respectively. A center portion of the slots 308 and 308' extends from one shoulder to the other to form a channel. The channel extends between the first and second walls 302 and 304 of the valve 300. The pockets 310, 312 and 310', 312' are shaped and extend a distance inward in the slots 308 and 308', respectively, to receive opposing pins 332 and 332', as described below in further detail with respect to FIGS. 31 and 32. Optionally, an opening 316, such as a V-shaped opening, is provided. The channel and opening 316 can be provided to reduce the weight of the jet valve flap 300.

A top portion of the jet valve flap 300 extends transversely between the upper shoulders 306 and 306'. An inverted V-shaped rib 318 is formed along the top portion between the opposing shoulders 306 and 306', and includes a curved spine 320 for smooth sliding and engagement of a spring 322, which is shown and described below with respect to FIGS. 31 through 34.

Referring to FIGS. 31-35, the jet valve housing 32 includes a jet valve chamber 325 positioned over the propeller 351 of the pump (not shown). The valve chamber 325 has an interior that is circular in shape to accommodate the whirling water propelled upward by the propeller 351 of the pump. The valve chamber 325 is also substantially triangular in shape with the apex of the chamber 325 serving to rotatably mount the jet valve flap 300 so that it can swing back and forth between a pair of opposing outlets 340 and 342.

The opposing outlets 340 and 342 extend from the valve chamber 325 in the forward and rearward directions of the cleaner. The outlets 340 and 342 expel the pumped water therefrom to move the cleaner is a forward direction, as described above with respect to FIGS. 6-28. The valve chamber 325 further includes diametrically opposed ports or taps 346 and 348, which provide a flow of pressurized water via connecting tubes to at least one forward nozzle for cleaning the pool surface beneath the cleaner, as described above with respect to FIGS. 20-28.

Referring to FIGS. 31 and 32, the jet valve flap 300 is slidably mounted at the apex of the valve chamber 325 such that the top portion and side walls 302 and 304 extend normal with respect to the opposing outlets 340 and 342. In this manner, the valve 300 can be positioned to open one outlet (e.g., outlet 342) while closing the opposing outlet (e.g., outlet 340), as shown in FIG. 35.

In one embodiment, the valve 300 is supported in the opposing pockets 310 and 310' by opposing pins 332 and 332', respectively extending inward proximate the apex along the central axis of the chamber 325. In one embodiment, the pins 332 and 332' are formed as an integral part of the valve chamber 325 and have tapered tips 334 and 334' for easier assembly. Alternatively, the pins 332 and 332' can be fastened (e.g., pressure fitted, screwed, and the like) separately to the chamber 325. The pins 332 and 332' can also have wide flat tapered bases 336 and 336' to prevent the two edges of the jet valve flap 300 from rubbing against the inner side of the chamber 325, as shown in FIG. 32.

As shown in FIG. 31, during operation the propeller 351 of the pump (not shown) illustratively rotates in a counter-clockwise direction, and the spring 322 presses down on spine 320 of the valve 300. The propeller 351 directs the water upwards and counter-clockwise against the side wall 302 of the valve 300, as shown by arrows 338, and forces the valve 300 to pivot about the pins 332 and 332' until the opposing side wall 304 of the valve 300 comes into contact with an inner portion of the outlet 340, thereby closing outlet 340.

As shown in FIGS. 31 and 35, the opposing outlet 342 is now in an open state, and a large portion of the water is expelled therefrom to cause the cleaner to move in a forward direction (e.g., to the right of the figures). When the pump is turned off (e.g., to reverse direction after a forward direction portion of the cleaner contacts a substantially perpendicular side wall of the pool), the pressure from spring 322 on spine 320 (see FIG. 33) forces valve 300 to pivot on pins 332 and 332' until bottom edge 301 of the valve 300 comes in contact with lower end of the opposing outlet 342 (see FIG. 34).

After a predetermined time (e.g., one second), the pump is turned on again (e.g., to reverse direction), and the water pressure from the pump will push the upper end of the valve to close the outlet 342, thereby overcoming the downward pressure exerted by the spring 322, as shown by arrow 321 of FIG. 33. Removal of the spring pressure along the spine 320 enables the valve 300 to slide over the pins 332 and 332' such that the valve 300 slides from placement of the pins 332 and 332' in pockets 310 and 310' to placement of the pins 332 and 332' in pockets 312 and 312'. Thus, the position of the valve 300 will be the exact opposite of that shown in FIG. 31.

Referring to FIGS. 29 and 30, the inner shoulders or protrusions 344 and 344' prevent unwanted sliding of the pins 332 and 332' between pockets 310, 310' and 312, 312', respectively, while the cleaner is moving in the forward direction. Referring to FIG. 33, the interior ceiling at the apex of the chamber 325, on which spring 322 rests, is shaped like a flat wedge 345 to enable the spring 322 to pivot back and forth as the valve 300 swivels forward and rearward (left and right in the drawings) to the alternate pocket positions. As further shown in FIG. 33, the spring 322 is angularly positioned to gain leverage on the valve 300.

The valve 300 and its associated chamber 325 of the housing 330 are also designed to provide water jet streams to stir up debris under the cleaner. The valve chamber 325 is specially designed to provide a dynamic restriction on one jet stream while enhancing the other, and vice-versa. This is done without additional flanges on the sides of valve 300, as described above with respect to FIGS. 23-25. Instead, the shape and location of taps 346 and 348 are such that only one of them at a time is in a favorable position to gather considerably larger amounts of water than the other. The result is a simpler configuration of the jet valve flap 300 and the jet valve chamber 325, which helps reduce the manufacturing costs of the cleaner.

Referring to FIG. 35, the whirling water, shown by arrows 350 above propeller 351, is moving in a counter-clockwise direction. The outlet 342 is open, and accordingly, most of the water shown by arrows 353 is expelled therefrom. Further, opposing (right) outlet 340 is occluded by valve 300. Thus, the whirling water shown by arrows 354 is guided toward tap 346. The tap 346 is shaped to match the contour of valve 300. As shown in FIG. 31, the tap 346 is elongated and convexly curved in shape, which results in a smooth, unobstructed flow of the water directly into tap 346, as shown by arrow 358 in FIG. 35. The water flowing through tap 346 continues through the connecting tube to the nozzle positioned in the direction of forward movement of the cleaner as described above with respect to the previous embodiments described herein.

Referring again to FIG. 35, the opposing tap 348 will only receive a minimal amount of water flow, as depicted by arrow 360, as compared to the amount of water expelled by outlet 342 and tap 346. In particular, the counter-clockwise whirling water from the pump can be expelled through three available ports, which include the tap 346, the outlet 342 and the opposing tap 348. A first portion of the whirling water is expelled at a high pressure through the first tap 346 and is directed to the forward direction nozzle, as described above to clean the debris from the pool surface beneath the cleaner. A substantial portion of the water from the pump that is not expelled through tap 346 flows through the larger outlet 342 to jet propel the cleaner in the forward direction. The momentum of the whirling water from the pump may cause a small portion of water to flow past first the tap 346 and then the outlet 342, such that any small excess or overflow of water can be expelled through the opposing tap 348.

Specifically, as the valve 300 is not positioned to occlude the outlet 342 and direct the water directly into the tap 348, the water pressure at the tap 348 is greatly reduced. However, the momentum of the swirling water can cause residual amounts of water to flow into the opposing contoured tap 348. The water that flows through tap 348 is minimal as compared to the water flowing through tap 346 and outlet 342. The excess water flowing through tap 348 continues through a connecting tube and is discharged through the rearward direction nozzle via a connecting tube. As shown in FIG. 35, water flow arrows 358 and 360 indicate the volume differential exiting the valve chamber 335.

It is noted that a person of ordinary skill in the art will appreciate that when the valve 300 is pivoted towards the left side of valve chamber 335, i.e., occluding outlet 342, then outlet 340 remains open. The counter-clockwise swirling water generated by the pump will cause the swirling water to flow primarily through tap 348 and outlet 342, and a minimal amount of overflow will be expelled from the chamber 325 through tap 346. Specifically, as illustratively shown in FIG. 31 of the drawings, the propeller 351 is designed to turn counter-clockwise (shown by arrow 355) to pump water toward valve 300.

It is further noted that if the pump is designed to rotate in a clockwise direction, then the taps 346 and 348 would be positioned diametrically to their opposite sides. For example, referring to FIG. 31, tap 346 would be positioned as shown by phantom line 347, and tap 348 would be positioned diametrically opposed to phantom line 347.

Previously known valve designs have included three moving parts, i.e., the valve body, a spring and toggle. The toggle serves as a surrogate to deliver force from one side of the valve to the other side. Advantageously, the present embodiment only requires a valve flap and a spring, thereby reducing manufacturing costs and improving reliability of the jet valves. Moreover, eliminating the requirement of a toggle enables the valve to completely close and block the adjacent outlet to thereby minimize leakage through the occluded outlet.

Figure 36:
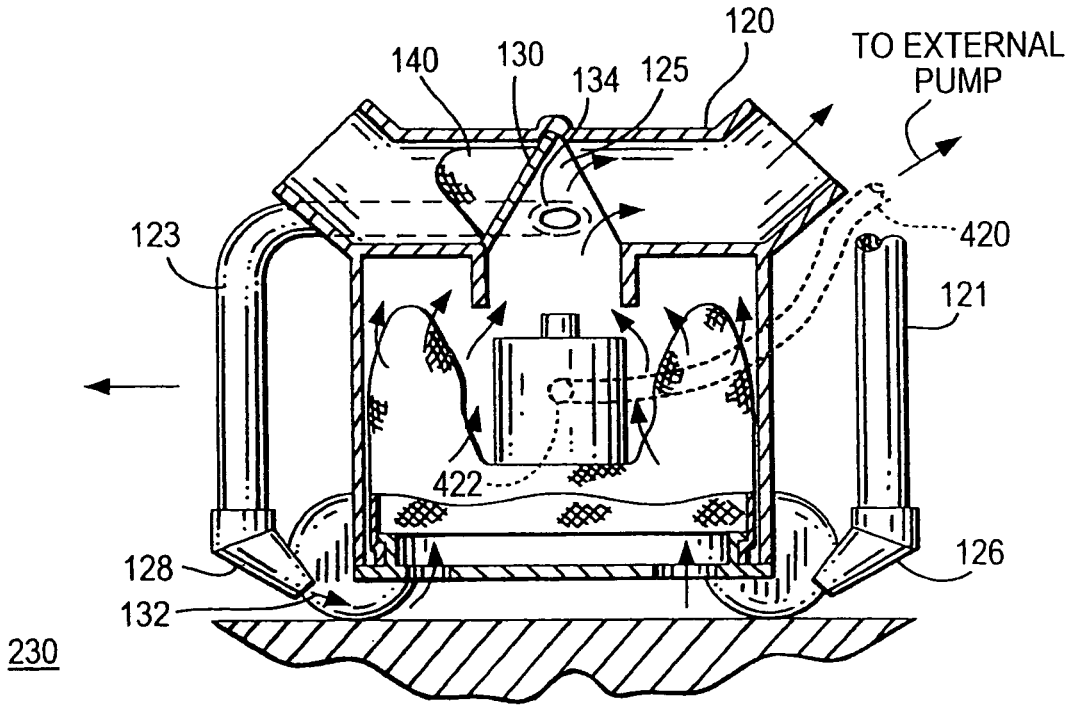
FIG. 36 is a side elevational view partly in cross-section of the embodiment of the invention utilized with a cleaner that is moved about the pool by water jet propulsion from an externally located pump.

Referring to FIG. 36, although the present embodiments have been described with the pump being located internally within the housing of the cleaner, a person of ordinary skill in the art will appreciate that an external pump can be used with the cleaner. In this embodiment, the external pump draws water from the pool via an inlet port, illustratively from a hose extending into the water of the pool. The drawn water from the pool is pumped to the cleaner via an outlet hose 420 that is rotatably fastened to an inlet port 422 formed in the housing of the cleaner.

The water from the pump is directed upward into the valve chamber 125 of the cleaner and will propel the cleaner in a forward direction based on the positioning of the spring loaded jet valve flap 138. Both the forward and rearward direction nozzles 126 and 128 will expel a cleaning water jet beneath the bottom surface of the pool cleaner to lift any debris in a manner described above. In the instance where it is desirable that the cleaning water jet stream be expelled from only the forward direction nozzle, then the jet valve flap 138 with diametrically opposing first and second flanges 140 and 142, and arrangement of the opposing ports 134 and 136 in the valve chamber 125 can be implemented as described with respect to FIGS. 23-25.

Advantageously, the size of the jet valve housing can be significantly reduced when utilizing an external pump system with the cleaner. In particular, the size of the jet valve housing is dictated in part by the size of the on-board pump that is required to generate sufficient water flow to propel the cleaner and provide the cleaning water jets. As the external pump can provide water at greater pressure than an on-board pump, the size of the jet valve housing and its associated components can be significantly reduced in size (e.g., approximately half the size) to propel the cleaner in the forward direction in the same manner as the on-board cleaner.

Variations of the embodiments described above are also contemplated. For example, the flap valves 162, solenoid and protrusion member nozzle arrangement of FIGS. 26-28 for lifting the cleaner when contacting a perpendicular pool surface can be implemented with the diametrically opposed port and jet valve flap arrangements described with respect to the embodiments of FIGS. 20-25 and 31-35 is also contemplated. Further, any of the embodiments can be implemented with an internal pump or external pump. A person of ordinary skill in the art will appreciate that other combinations of the embodiments described herein are also contemplated and should not be considered as being limiting.

While the foregoing is directed to various embodiments of the present invention, additional embodiments of the invention may be devised without departing from the basic disclosure, and the scope of the invention is to be determined by the claims that follow.

We claim:

1. A pool cleaning apparatus comprising:

a housing;

an associated filter for entraining dirt and debris;

a baseplate extending along the bottom of the housing;

at least one intake port formed in the baseplate for admitting water into the filter;

pump means for drawing water from beneath the baseplate of the pool cleaning apparatus and through the filter;

a pair of directional cleaning water jet nozzles, each nozzle for discharging a pressurized water jet stream at a first pool surface beneath the pool cleaning apparatus as the cleaning apparatus moves in a forward direction, wherein one of the pair of nozzles is mounted at a front end of the housing and the other is mounted on a rear end of the housing, and whereby dirt and debris resting on the first surface that is contacted by the pressurized stream in the forward direction is lifted into suspension proximate the intake port; and a jet valve housing mounted on the housing and having a jet valve for directing a propulsion jet stream from the pump means through one of a pair of opposing propulsion outlets for propelling the cleaning apparatus in the forward direction, the jet valve housing further including a pair of opposing ports for admitting the pressurized water jet stream to the nozzle mounted at the front end of the housing.

2. The apparatus of claim 1 which is self-propelled.

3. The apparatus of claim 1, wherein the pump means is located inside of the housing.

4. The apparatus of claim 1, wherein the pump means is located remotely from the housing.

5. The apparatus of claim 1, wherein the at least one intake port is positioned normal to a longitudinal axis extending in the direction of movement of the pool cleaning apparatus.

6. The apparatus of claim 1, wherein each of the pair of opposing ports is coupled to one of the nozzles via a respective connecting tube.

7. The apparatus of claim 1, wherein the pair of opposing ports are diametrically opposing ports.

8. The apparatus of claim 1, wherein the jet valve is a planar flap rotatably connected normal to the longitudinal axis within said jet valve housing.

9. The apparatus of claim 8, wherein said jet valve is rotated in a first position to close a forward directed propulsion outlet of said propulsion outlets, and provide the propulsion jet stream through the other of said propulsion outlets that is directed rearward.

10. The apparatus of claim 9, wherein the pressurized water jet stream is provided through one of the pair of opposing ports to said nozzle mounted at the front end of the housing.

11. The apparatus of claim 8, wherein said jet valve further comprises diametrically opposing flanges extending longitudinally outward.

12. The apparatus of claim 11, wherein said jet valve flap is in a first position when said cleaning apparatus is moving in the forward direction and one of said diametrically opposing flanges closes an adjacent port and the other diametrically opposing flange maintains the other opposing port in said jet valve housing in an open state for providing the pressurized water jet stream to said nozzle mounted at the front end of the housing.

13. The apparatus of claim 12, wherein the jet valve flap rotates to a second position when the cleaning apparatus moves in an opposite direction such that the previously closed port is opened and the previously opened port is closed by the diametrically opposing flanges to provide the pressurized water jet stream to said nozzle mounted at the front end of the housing.

14. The apparatus of claim 1 wherein said pair of nozzles is centrally positioned over the front and rear ends of said housing.

15. The apparatus of claim 14 further comprising:

a pair of opposing flap valves for partially opening and closing the pair of opposing propulsion outlets of said jet valve housing;

a switch for controlling the opening and closing of the pair of opposing propulsion outlets; and an activation means for activating said switch.

16. The apparatus of claim 15, wherein said flap valves are linked via a linking member to contemporaneously open and close said flap valves.

17. The apparatus of claim 16, wherein the activation means comprises:

a lever rotatably attached to a side of said housing, said lever having a first end extending a distance outward from the housing in the forward direction, said lever having a second end for engaging said switch in response to the first end engaging a second surface that is substantially perpendicular with respect to the first surface of the pool.

18. The apparatus of claim 17, wherein said switch comprises a reed switch and the second end of said lever includes a magnet for activating said reed switch.

19. The apparatus of claim 18, wherein said reed switch is electrically connected to a solenoid for opening and closing said flap valves via said linking member in response to the first end of said lever engaging or disengaging the second surface of the pool.

20. The apparatus of claim 19, wherein said flap valves are closed and opened upon the first end of said lever engaging and disengaging, respectively, with the second surface of the pool.

21. The apparatus of claim 20, wherein the pressurized water jet increases through said nozzle mounted at the front end when the flap valves are closed, the pressurized water jet being directed downward to lift the front end of the cleaning apparatus off the first surface of the pool thereunder.

22. The apparatus of claim 21, wherein the pressurized water jet decreases through said nozzle mounted at the front end when the flap valves are opened, the pressurized water jet being redirected from being perpendicular to the surface below the cleaner to approximately 45 degrees rearwards towards the intake opening to clean debris along the second surface of the pool thereunder.

23. The apparatus of claim 15, wherein each nozzle further includes a deflector for partially closing a first portion of the nozzle.

24. The apparatus of claim 23, wherein each deflector is rotatably attached over a first portion of a nozzle outlet of said nozzle, wherein a second portion of said nozzle outlet remains open.

25. The apparatus of claim 24, wherein each deflector further comprises a deflector switch for opening and closing said deflector upon engaging and disengaging, respectively, the second surface of the pool.

26. The apparatus of claim 17, wherein said lever includes a roller rotatably coupled to the first end of said lever.

27. The apparatus of claim 21, wherein said flap valves open when the bottom of the cleaning apparatus is at and angle of approximately 45 degrees with respect to the first and second surfaces of the pool.

* * * * *